US009869965B2

(12) United States Patent
Inada

(10) Patent No.: US 9,869,965 B2
(45) Date of Patent: Jan. 16, 2018

(54) IMAGE FORMING APPARATUS

(71) Applicant: CANON KABUSHIKI KAISHA, Tokyo (JP)

(72) Inventor: Seiji Inada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/433,064

(22) Filed: Feb. 15, 2017

(65) Prior Publication Data

US 2017/0255159 A1 Sep. 7, 2017

(30) Foreign Application Priority Data

Mar. 1, 2016 (JP) ..... 2016-039336

(51) Int. Cl.
*G03G 21/16* (2006.01)

(52) U.S. Cl.
CPC ..... *G03G 21/1647* (2013.01); *G03G 21/1633* (2013.01)

(58) Field of Classification Search
CPC ..... G03G 21/1647; G03G 21/1633; G03G 2221/1654
See application file for complete search history.

(56) References Cited

U.S. PATENT DOCUMENTS 8,653,362 B2 2/2014 Tsujishita
8,873,977 B2 10/2014 Takahira et al.
2009/0317126 A1* 12/2009 Tomatsu ..... G03G 21/1633 399/110
2011/0293326 A1* 12/2011 Tanabe ..... G03G 21/1633 399/124
2011/0299873 A1* 12/2011 Ushiozu ..... G03G 21/1647 399/90
2012/0237254 A1* 9/2012 Fukuda ..... G03G 21/1633 399/114

FOREIGN PATENT DOCUMENTS

JP S56-162190 A 12/1981
JP 2004-138775 A 5/2004
JP 2009-301067 A 12/2009
JP 2011-230406 A 11/2011
JP 2012-232473 A 11/2012
JP 2013-190586 A 9/2013

* cited by examiner

*Primary Examiner* — Sandra Brase
(74) *Attorney, Agent, or Firm* — Fitzpatrick, Cella, Harper & Scinto

(57) ABSTRACT

An image forming apparatus includes a locking mechanism that locks an opening/closing door to an engagement position, the locking mechanism having a engaged member and an urging member that urges the engaged member; and an engagement member that is provided on the door and engages the engaged member; wherein an urging force acting on the engaged member from the urging member is converted from a first urging force to press out the engagement member to a second urging force to draw the engagement member into the engagement position when the door is closed; wherein the engagement member has a contacted region and the engaged member has a contact region that comes in contact with the contacted region; and wherein the contacted region elastically deforms when the contact region comes in contact with the contacted region.

6 Claims, 23 Drawing Sheets

IMAGE FORMING APPARATUS

BACKGROUND OF THE INVENTION

Field of the Invention

The present invention relates to an image forming apparatus such as a copier and a printer.

Description of the Related Art

Electrophotographic image forming apparatuses such as printers and copiers in which users replace components such as toner cartridges by opening/closing covers have been known, and various systems have been employed as locking mechanisms for the covers. For example, Japanese Patent Application Laid-open No. 2004-138775 discloses a configuration in which a user operates a handle to switch the position of a locking claw between a locking position and an unlocking position.

However, such a configuration in which a user operates the locking/unlocking position of a cover by a lever is not excellent in usability since it is difficult to determine a handle position or the user is not necessarily allowed to intuitively recognize an operating direction and an opening/closing direction. Therefore, as a locking mechanism for a cover to improve usability, a toggle mechanism may be used in which a user is allowed to automatically perform a drawing operation and a locking/unlocking operation, without operating a handle, as he/she opens and closes the cover.

In such a toggle mechanism, however, there is a neutral point at which an urging force is balanced in the midstream of a track along which a toggle lever rotates, and there is a point at which engagement looseness is rapidly eliminated before and after the lever has passed through the neutral point. At this time, an impact sound is generated when the toggle lever and a locked member on the side of a cover collide with each other or when a stopper member that holds the toggle lever at a standby position and the toggle lever collide with each other as the cover is opened. A description will be given, with reference to FIGS. 18A and 18B and FIGS. 19A and 19B, of a toggle mechanism.

FIG. 18A is a schematic cross-sectional view showing the configuration of a toggle mechanism and shows a state in which a toggle lever 114 is positioned at a neutral point. The toggle lever 114 is supported on a swing shaft 110 so as to be swingable about the swing shaft 110 with respect to a toggle holder 104. The toggle spring 113 is an expansion coil spring and has one end thereof attached to the toggle holder 104 and the other end thereof attached to the toggle lever 114. The toggle spring 113 continuously applies an urging force in a rotating direction to the toggle lever 114 while changing its urging force direction C as the toggle lever 114 swings. An engagement member 103 of a cover (not shown) is integrally formed with a toggle pressing region 108. When the engagement member 103 enters along a track indicated by an arrow F, the toggle lever 114 starts rotating in an arrow G direction. As shown in FIG. 18A, in a phase in which the toggle spring 113 applies the urging force to the toggle lever 114 in a direction toward the center of the swing shaft 110, the urging force of the toggle spring 113 is not converted into the rotating force of the toggle lever 114. That is, in this state, the toggle lever 114 is positioned at the neutral point. At this time, engagement looseness H exists between the toggle lever 114 and the engagement member 103, which represents looseness required for the components to reliably perform a swing operation without interference therebetween.

FIG. 18B is a schematic cross-sectional view showing the configuration of the toggle mechanism and shows a state in which the toggle lever 114 has passed through the neutral point and engages the engagement member 103 whereby the cover is locked to an apparatus main body. The engagement looseness H between the toggle lever 114 and the engagement member 103 is rapidly eliminated by the rotation of the toggle lever 114 and moves to the side of the toggle pressing region 108. At the same time, the toggle lever 114 comes in contact with the engagement member 103 by the urging force of the toggle spring 113 and completes its locking operation while urging the engagement member 103 in an arrow K direction. At this time, an impact sound is generated by an impact caused when the toggle lever 114 and the engagement member 103 collide with each other.

FIG. 19A is a schematic cross-sectional view showing the configuration of the toggle mechanism and shows a state immediately after the toggle lever 114 has passed through the neutral point when the cover is opened from its locked state. When the cover is opened from the locked state, the toggle lever 114 swings in an arrow J direction while receiving an urging force from the engagement member 103. After having passed through the neutral point as shown in FIG. 19A, the toggle lever 114 rotates in an arrow M direction by the urging force of the toggle spring 113. At this time, a gap L exists between the toggle lever 114 and a stopper region 105 that holds the toggle lever 114 at a standby position.

FIG. 19B is a schematic cross-sectional view showing the configuration of the toggle mechanism and shows a state in which the cover is opened and the toggle lever 114 is held at the standby position. The toggle lever 114 having passed through the neutral point rotates in the arrow M direction by the urging force of the toggle spring 113, the gap L between the toggle lever 114 and the stopper region 105 is rapidly eliminated, whereby the toggle lever 114 and the stopper region 105 come in contact with each other. By a collision at the contact, an impact sound is generated.

As described above, while being effective in terms of improving usability, the toggle mechanism does cause deterioration in an operation sound. In recent years, since some laser beam printers perform the pop-up operation of a toner cartridge in conjunction with a cover or hold one side of a sheet path with a jam processing cover to improve jam processing, there is a likelihood that a force required to perform the opening/closing operation of the cover increases. When a toggle mechanism is employed in the opening/closing mechanism of such an apparatus, the drawing force of a toggle lever is required to increase, which may result in deterioration in an impact sound. As means for reducing this impact sound, it is assumed to provide a buffer material such as moltopren on a collision region. However, a buffer material such as moltopren suffers from a problem in which creep deformation occurs when the buffer material receives the urging force of a toggle lever for a long period of time and the effect of the buffer material reduces.

SUMMARY OF THE INVENTION

The present invention has an object of providing a locking mechanism capable of reducing the occurrence of an impact sound without impairing usability.

An embodiment of the present invention provides an image forming apparatus including: a main body of the image forming apparatus; an opening/closing door openable/closable with respect to the main body; a locking mechanism that is provided on the main body and locks the opening/closing door to an engagement position, the locking mechanism having a rotatable engaged member and an urging member that urges the engaged member; and an engagement member that is provided on the opening/closing door and engages the engaged member, wherein the engaged member is pressed and rotated when the opening/closing door is closed with respect to the main body, wherein an urging force acting on the engaged member from the urging member is converted from a first urging force to press out the engagement member to a second urging force to draw the engagement member into the engagement position when the engaged member is pressed and rotated by the engagement member, wherein the engagement member has a contacted region and the engaged member has a contact region that comes in contact with the contacted region, and wherein the contacted region elastically deforms when the contact region comes in contact with the contacted region.

Further features of the present invention will become apparent from the following description of exemplary embodiments (with reference to the attached drawings).

DESCRIPTION OF THE EMBODIMENTS

Figure 1A:
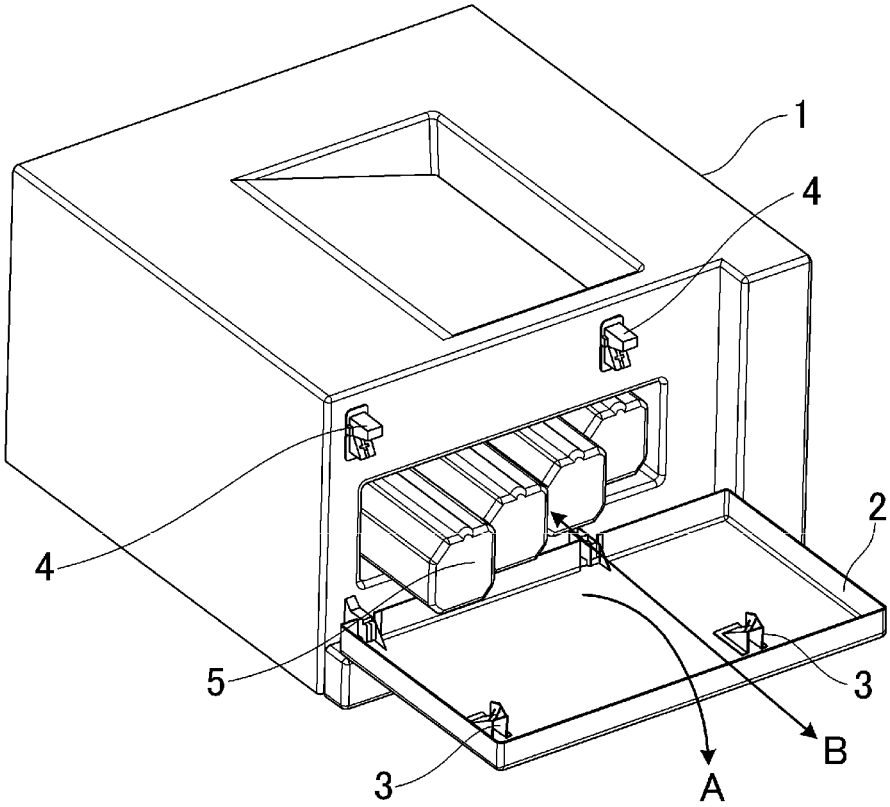
FIGS. 1A and 1B are perspective views of an image forming apparatus according to a first embodiment.

Hereinafter, a description will be given, with reference to the drawing, in detail of a mode for carrying out the invention based on embodiments. However, the dimensions, materials, shapes, their relative arrangements, or the like of constituents described in the mode may be appropriately changed according to the configurations and various conditions of apparatuses to which the invention is applied. That is, the dimensions, materials, shapes, their relative arrangements, or the like do not intend to limit the scope of the invention to the following mode.

First Embodiment

Figure 1B:
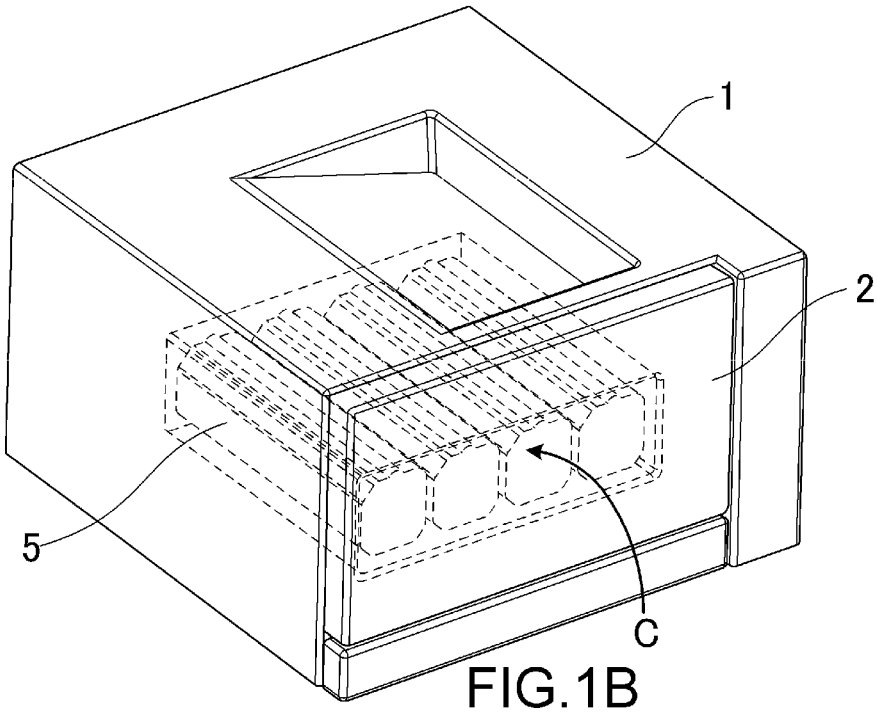

FIGS. 1A and 1B are schematic perspective views of an image forming apparatus to which a locking mechanism according to an embodiment of the present invention is applied. FIGS. 1A and 1B show a state in which a front cover 2 is opened with respect to an image forming apparatus main body 1 and a state in which the front cover 2 is closed with respect to the image forming apparatus main body 1, respectively.

As shown in FIG. 1A, the front cover 2 serving as an opening/closing door is configured to rotate in an arrow A direction with respect to the apparatus main body 1 to be allowed to open the inside of the apparatus main body 1, and allows a user to access the inside of the apparatus main body 1. The arrow A direction is a rotating direction about an axis parallel to a horizontal surface representing an installation surface for the image forming apparatus. Process cartridges 5 are cartridges obtained by integrating processing means such as a photosensitive member and developing means and made to be attachable/detachable to/from the apparatus main body 1. In the embodiment, the process cartridges 5 are attachable/detachable in an arrow B direction. The arrow B direction is a direction parallel to the horizontal surface. On the surface of the apparatus main body 1 where the front cover 2 at its closed position faces, toggle holders 4 having a toggle mechanism for locking the front cover 2 to the closed position are fixed. On the other hand, on the surface of the front cover 2 (rear surface of the front cover 2) that faces the apparatus main body 1, engagement portions (engagement members) 3 that engage the toggle mechanisms of the toggle holders 4 are fixed at positions corresponding to the toggle holders 4. That is, the engagement portions 3 serving as engagement members are provided on the front cover 2 representing one of the two members movable relative to each other, and the toggle holders 4 having a toggle lever 14 serving as an engaged member that will be described later are provided on the apparatus main body 1 representing the other of the two members. The toggle holders 4 are provided at two upper places of an opening for the process cartridge 5 in the apparatus main body 1. The engagement state between the toggle holders 4 and the engagement portions 3 is cancelled when the user applies a force to the front cover 2 in the arrow A direction. As described above, the locking mechanism for locking the opening/closing door 2 has the engaged members 14 that are rotatable and urging members 13 that urge the engaged members 14.

As shown in FIG. 1B, when the front cover 2 is rotated by the operation of the user in an arrow C direction with respect to the apparatus main body 1 in the state shown in FIG. 1A, the engagement portions 3 are locked by the toggle mechanisms of the toggle holders 4 at the positions shown in FIG. 1B. The arrow C direction is a rotating direction about the axis parallel to the horizontal surface and opposite to the arrow A direction. By the closing operation of the front cover 2, the process cartridges 5 are attached at prescribed positions inside the apparatus main body 1 to allow the image forming apparatus to perform image formation.

Figure 2:
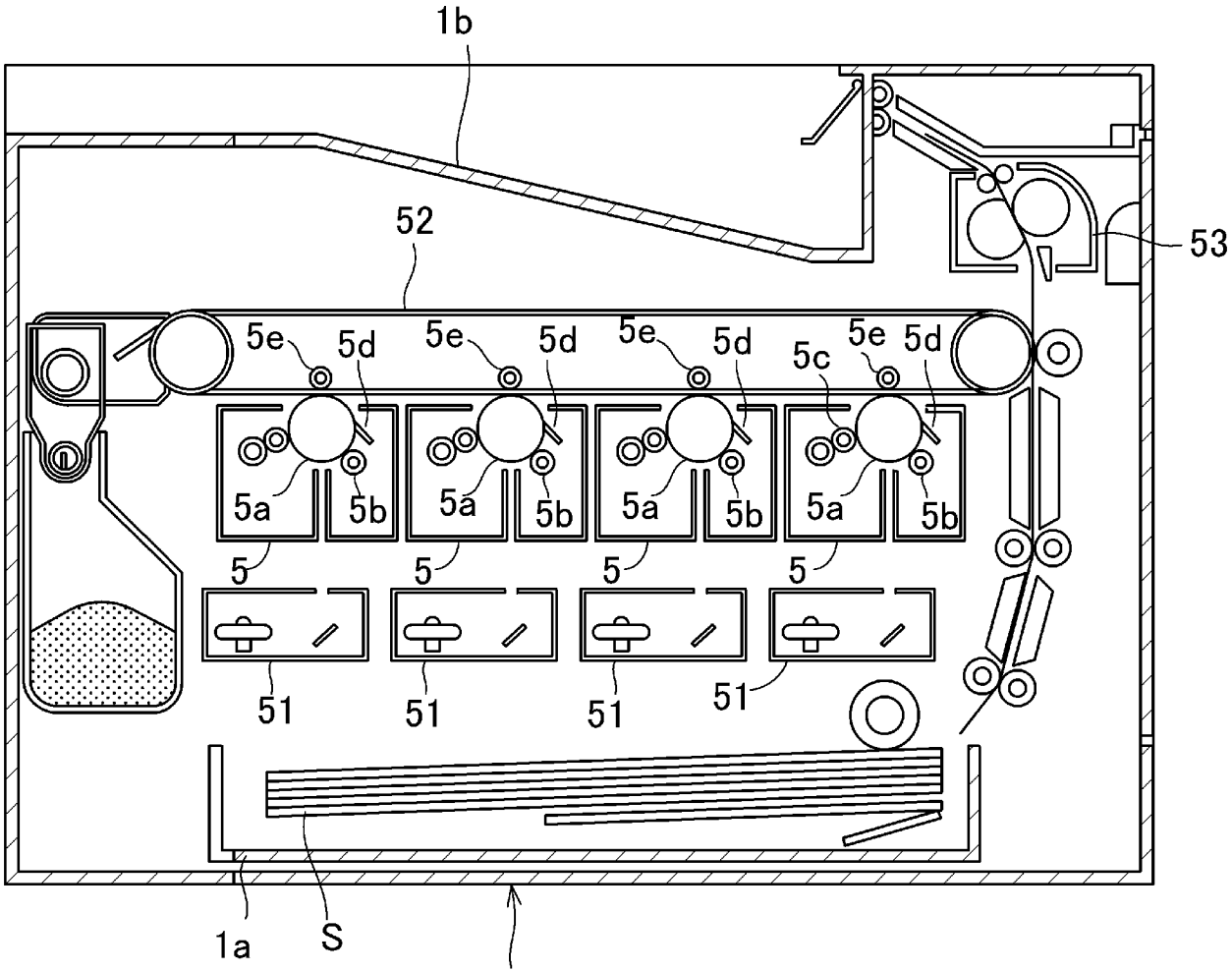
FIG. 2 is a schematic cross-sectional view of the image forming apparatus according to the first embodiment.

FIG. 2 is a schematic cross-sectional view showing the schematic configuration of the image forming apparatus according to the embodiment of the present invention. Each of the process cartridges 5 is obtained by integrating processing means for performing an electrophotographic process such as charging means such as a charging roller 5*b*, developing means such as a developing roller 5*c*, and cleaning means such as a cleaning member 5*d* around a photosensitive drum 5*a* serving as an image bearing member. The image formation is performed in such a manner that, in each of the process cartridges 5, image information of each color is exposed by a laser exposure apparatus 51 onto the front surface of the photosensitive drum 5*a* charged by a charging roller 5*b* and then toner is attached by a developing roller 5*c* onto the image information to form a toner image. A recording material S is transported from a sheet feeding cassette 1*a* provided beneath the apparatus main body 1, and the toner image of each color, which is formed by each of the process cartridges 5 and transferred by a transfer roller 5*e* onto an intermediate transfer belt 52, is transferred onto the recording material S so as to be overlapped. Then, after the transferred toner images are fixed by a fixing apparatus 53, the recording material S is discharged onto a sheet catching tray 1*b* provided on the upper surface of the apparatus main body 1.

Figure 3A:
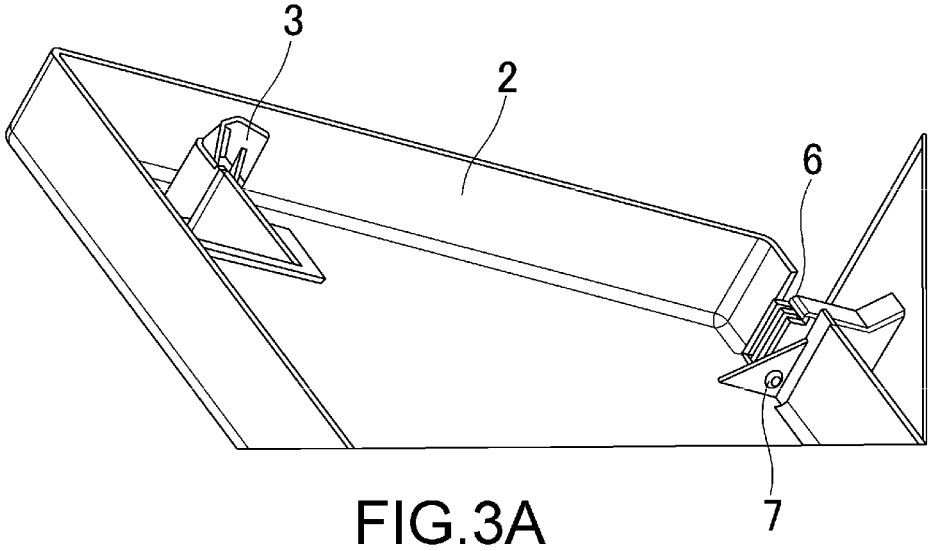
FIGS. 3A and 3B are a schematic view of a front cover rotating portion and a view for describing the details of an engagement portion according to the first embodiment, respectively.
Figure 3B:
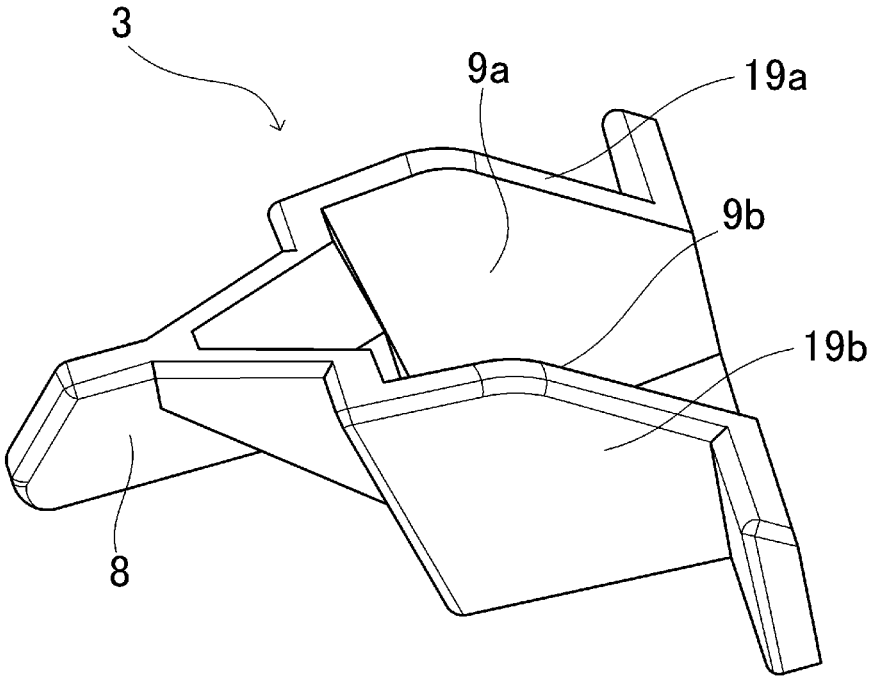

FIG. 3A is a schematic perspective view showing the rotating portion of the front cover 2. At the lower part of the apparatus main body 1, a cover holding portion 6 that rotatably supports the front cover 2 with a rotating shaft parallel to the horizontal surface is fixed. The front cover 2 is supported by the cover holding portion 6 with a cover rotating shaft 7 serving as a rotating center. FIG. 3B is a view showing the details of the engagement portion 3 fixed onto the rear surface of the front cover 2. The engagement portion 3 serving as an engagement member is a member in which a projection region 8 that presses and rotates the toggle mechanism and a contacted region to be locked by the toggle mechanism are integrally formed. The contacted region has contacted surfaces 9*a* and 9*b*.

Figure 4A:
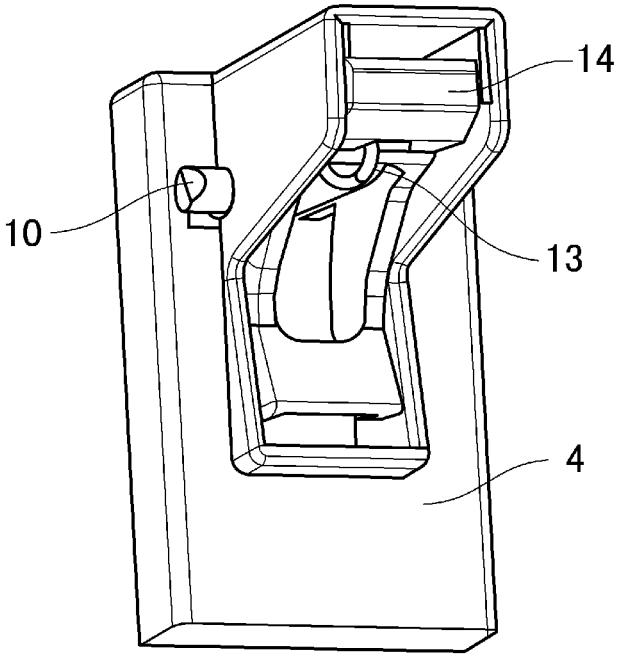
FIGS. 4A and 4B are schematic views of a toggle mechanism according to the first embodiment.
Figure 4B:
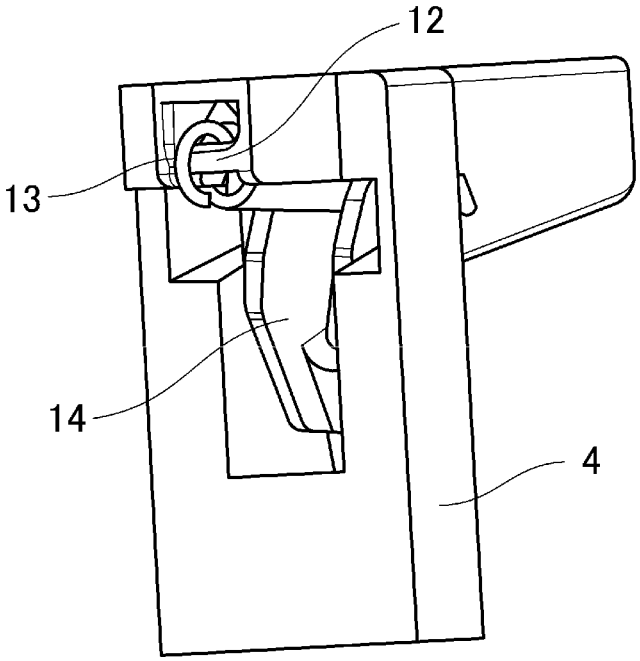

FIGS. 4A and 4B are schematic views of the toggle holder 4 having the toggle mechanism. FIG. 4A is a perspective view of the toggle holder 4 when seen from a side where the engagement portion 3 engages, and FIG. 4B is a perspective view of the toggle holder 4 when seen from a side opposite to the side where the engagement portion 3 engages. As shown in FIG. 4A, in the toggle holder 4, the toggle lever 14 where the engagement portion 3 engages so as to lock the front cover 2 to the apparatus main body 1 is supported on a swing shaft 10 in a swingable manner about the swing shaft 10. In the embodiment, the toggle lever 14 serving as an engaged member is configured to be movable on the other member, i.e., the apparatus main body 1 via the toggle holder 4. In addition, as shown in FIG. 4B, at the rear surface of the toggle holder 4, one end of a toggle spring 13 serving as an urging member that applies an urging force to the toggle lever 14 is rotatably held by a spring holding region 12 of the toggle holder 4.

Figure 5A:
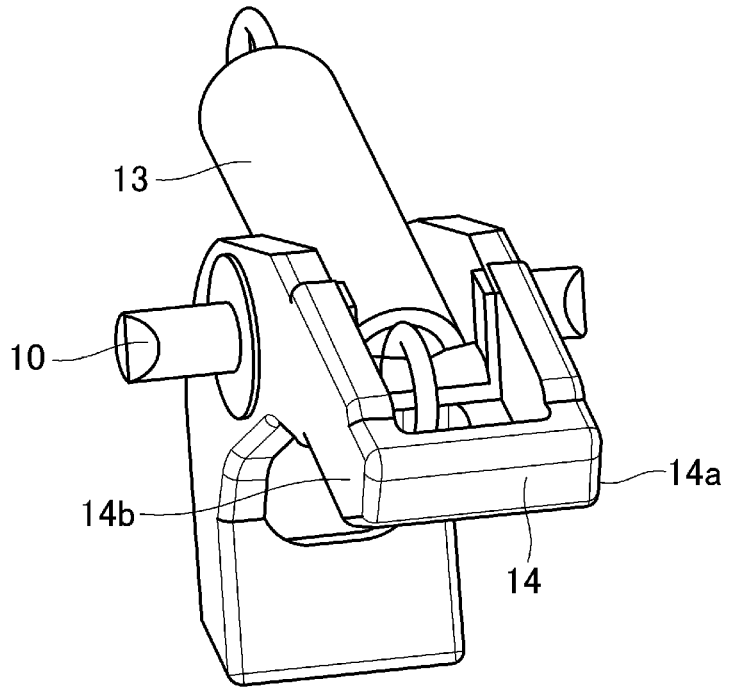
FIGS. 5A and 5B are views for describing the details of the toggle mechanism according to the first embodiment.
Figure 5B:
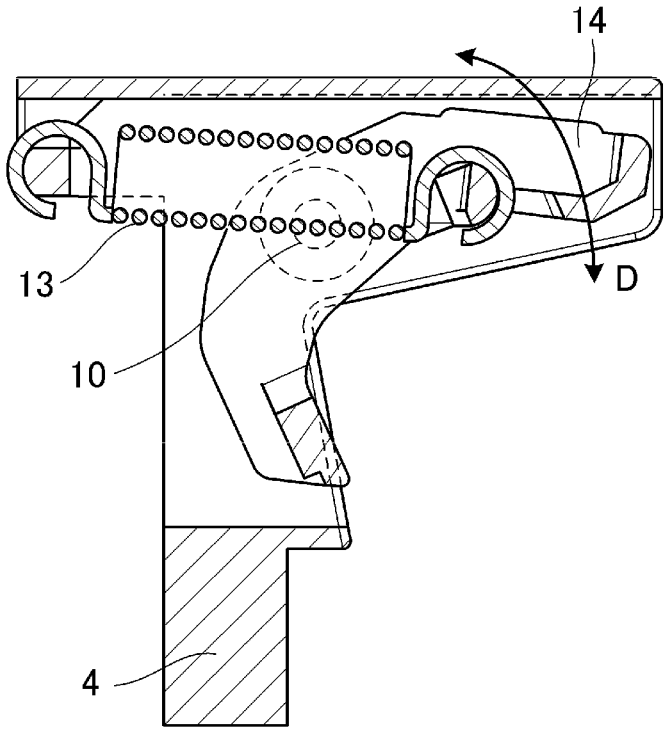

FIGS. 5A and 5B are views for describing the details of the inside of the toggle holder 4. FIG. 5A is a perspective view of the toggle lever 14 and the toggle spring 13 when seen from the side where the engagement portion 3 engages, and FIG. 5B is a schematic cross-sectional view of the toggle holder 4, the toggle lever 14, and the toggle spring 13. As shown in FIG. 5A, one end of the toggle spring 13 is rotatably held with respect to the toggle lever 14. The toggle lever 14 is rotatably supported by the toggle holder 4 (the apparatus main body 1 via the toggle holder 4) and coupled to the toggle holder 4 via the toggle spring 13. In addition, the toggle lever 14 has contact regions 14*a* and 14*b* that come in contact with the contacted surfaces 9*a* and 9*b* of the engagement portion 3, respectively, at the time of locking. In addition, as shown in FIG. 5B, the toggle spring 13 is an extension coil spring having one end thereof attached to the toggle holder 4 and the other end thereof attached to the toggle lever 14. As the toggle lever 14 swings in an arrow D direction, the toggle spring 13 applies an urging force in a rotating direction according to the rotating phase of the toggle lever 14 to the toggle lever 14 while changing its posture.

(Engagement Operation of Toggle Mechanism from Opening State to Closed State of Front Cover 2)

Figure 6A:
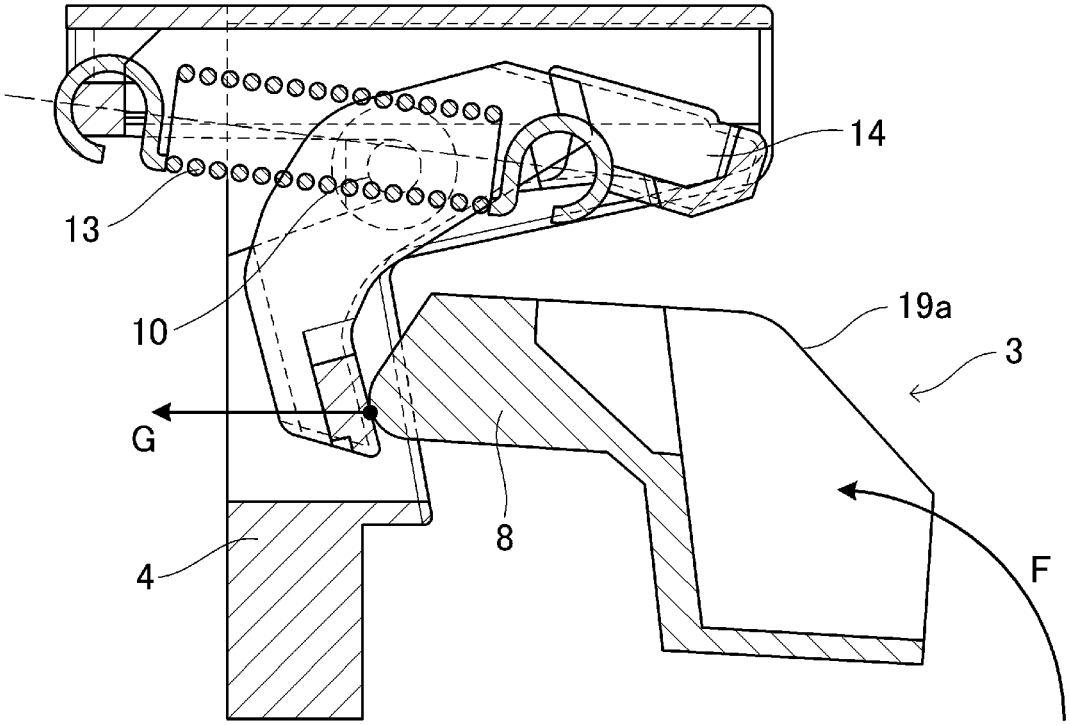
FIG. 6A is a view for describing the engagement operation of the toggle mechanism according to the first embodiment.

FIG. 6A is a view for describing the operation (engagement operation) of the toggle mechanism and a schematic cross-sectional view showing a state before the toggle lever 14 has reached a neutral point at which the axis line (line of action of the urging force) of the toggle spring 13 coincides with the rotating shaft (swing shaft 10) of the toggle lever 14. The engagement member 3 fixed onto the front cover 2 is integrally formed with a toggle pressing region 8. When the toggle pressing region 8 enters along a track indicated by an arrow F and abuts against the toggle lever 14 to press the toggle lever 14 in an arrow G direction, the toggle lever 14 starts rotating with the swing shaft 10 as a rotating center. At this time, the toggle spring 13 also follows the movement of the toggle lever 14 while changing its operation length and posture (angle of the line of action of the urging force). Note that an arrow F direction is a rotating direction with the axis parallel to the horizontal surface as a rotating center. In the state shown in FIG. 6A, the urging force of the toggle spring 13 acting on the toggle lever 14 acts so as to rotate the toggle lever 14 counterclockwise in FIG. 6A showing a cross section perpendicular to the rotating shaft (swing shaft 10) of the toggle lever 14. The urging force is an urging force (first urging force) to move the toggle lever 14 to be away from an engagement position with the engagement portion 3 that will be described later. That is, the first urging force is a force to urge the engagement member in a direction in which the engagement member is pressed out. When the user presses the front cover 2 against the urging force with respect to the apparatus main body, the toggle lever 14 rotates in the manner described above. By the rotation, the toggle lever 14 moves from a region (first region) on which the above urging force acts to the neutral point in the rotating movement range (rotating phase range) of the toggle lever 14.

Figure 6B:
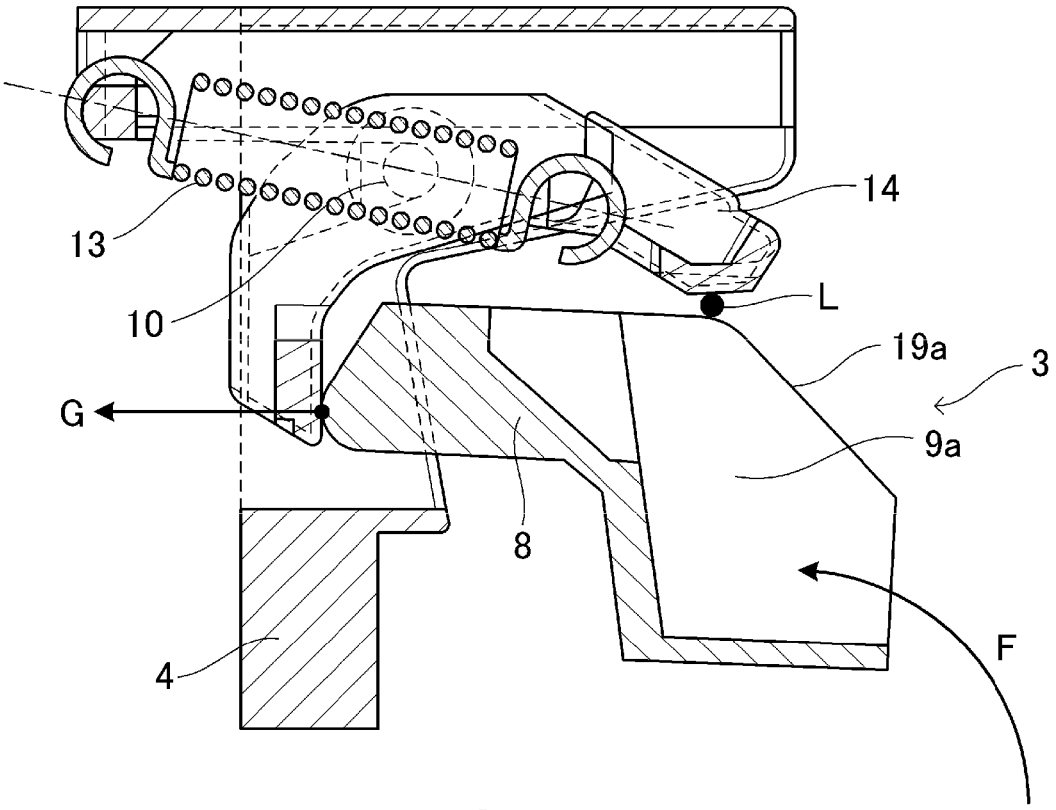
FIG. 6B is a view for describing the engagement operation of the toggle mechanism according to the first embodiment.

FIG. 6B is a view for describing the operation (engagement operation) of the toggle mechanism and a schematic cross-sectional view showing a state when the toggle lever 14 has reached the neutral point at which the axis line (line of action of the urging force) of the toggle spring 13 coincides with the rotating shaft (swing shaft 10) of the toggle lever 14. As shown in FIG. 6B, in a phase in which the line of action of the urging force of the toggle spring 13 coincides with the rotating center of the toggle lever 14 (center of the swing shaft 10), the urging force of the toggle spring 13 is not converted into the rotating force of the toggle lever 14. That is, the neutral point is a position (phase) at which neither the urging force (first urging force) to rotate the toggle lever 14 in a direction away from the engagement position with the engagement portion 3, nor an urging force (second urging force) to rotate the toggle lever 14 to be close to the engagement position, act. At this time, a gap L exists between (the contact regions 14*a* and 14*b* of) the toggle lever 14 and (the contacted surfaces 9*a* and 9*b* serving as a pair of abutted surfaces of) the engagement portion 3.

Figure 6C:
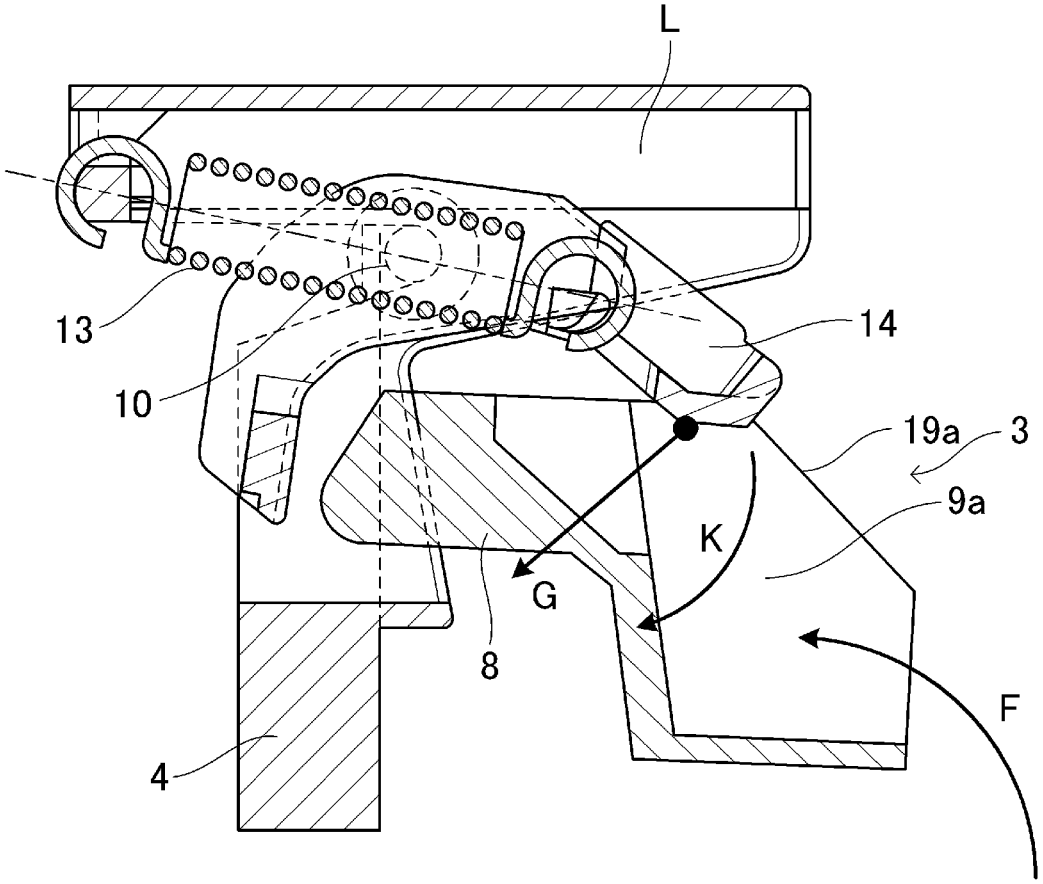
FIG. 6C is a view for describing the engagement operation of the toggle mechanism according to the first embodiment.

FIG. 6C is a view for describing the operation (engagement operation) of the toggle mechanism and a schematic cross-sectional view showing a state after the toggle lever 14 has passed through the neutral point at which the axis line (line of action of the urging force) of the toggle spring 13 coincides with the rotating shaft (swing shaft 10) of the toggle lever 14. When the toggle lever 14 is pressed by the toggle pressing region 8 to exceed the neutral point, the toggle spring 13 passes through the center of the swing shaft 10 of the toggle lever 14 to generate a force to rotate the toggle lever 14 in an arrow K direction as shown in FIG. 6C. The urging force is an urging force (second urging force) to rotate and move the toggle lever 14 to the engagement position with the engagement portion 3. That is, when the toggle lever 14 is pressed by the toggle pressing region 8, the phase of the toggle lever 14 changes across the neutral point from the region (first region) on which the first urging force acts to a region (second region) on which the second urging force acts. The toggle pressing region 8 of the engagement portion 3 is a configuration to change the acting state of the urging force of the toggle lever 14 until the toggle lever 14 is moved to the engagement position by the urging force of the toggle spring 13. By the above rotation of the toggle lever 14, the gap L is eliminated at a stroke. As a result, the contact regions 14*a* and 14*b* of the toggle lever 14 collide with the contacted surfaces 9*a* and 9*b* of the engagement portion 3, respectively.

Figure 7A:
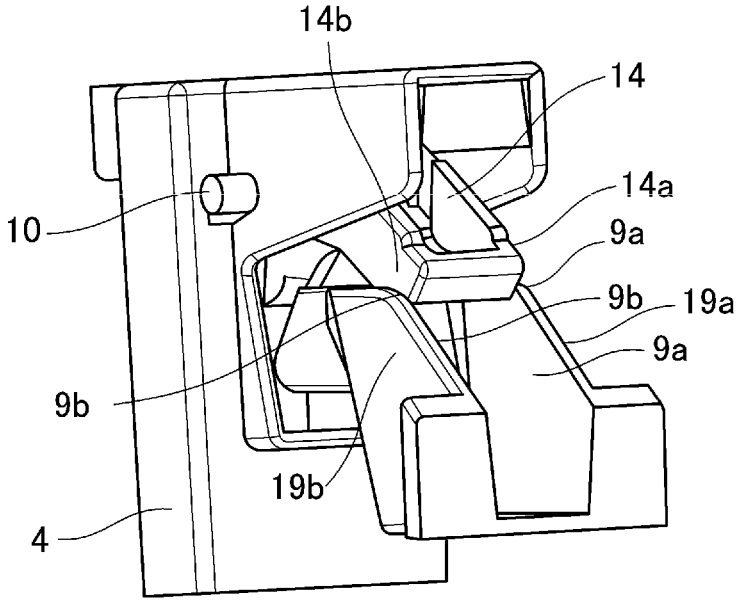
FIGS. 7A and 7B are schematic views for describing the details of the toggle mechanism according to the first embodiment.
Figure 7B:
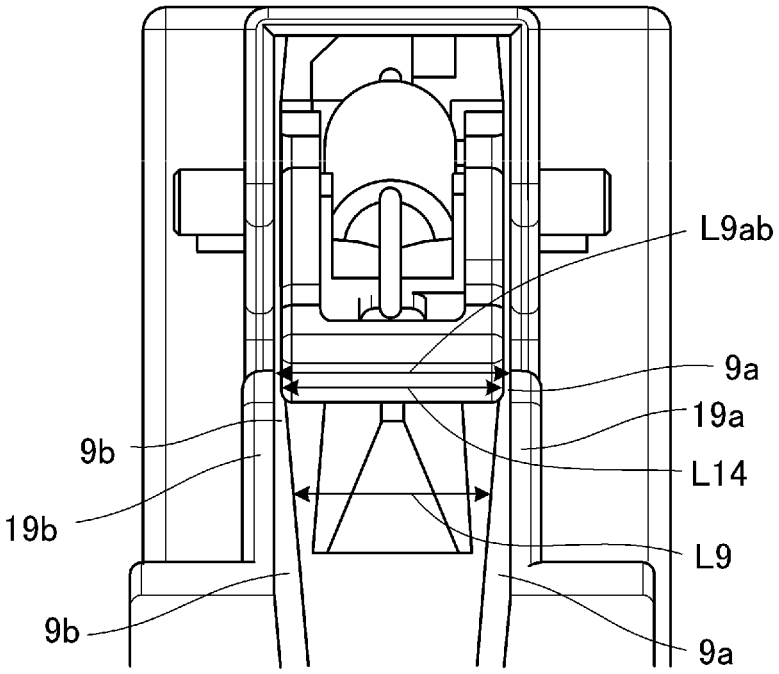

FIGS. 7A and 7B are schematic views for describing a state in which the contact regions 14*a* and 14*b* of the toggle lever 14 are abutted against the contacted surfaces 9*a* and 9*b* of the engagement portion 3, respectively. FIG. 7A is a perspective view, and FIG. 7B is a front view when seen in a direction perpendicular to the rotating shaft from the side of the engagement portion 3. As shown in FIG. 7B, the contacted surfaces 9*a* and 9*b* of the engagement portion 3 are inclined surfaces inclined to make its facing interval wider on a side where the toggle lever 14 approaches. When rotating in the arrow K direction shown in FIG. 6C, the toggle lever 14 first passes through an entrance region at which the facing interval between the contacted surfaces 9*a* and 9*b* is the widest and then enters the facing region of the contacted surfaces 9*a* and 9*b*. That is, the width between the contact regions 14*a* and 14*b* (a distance L14 between the contact regions 14*a* and 14*b*) of the toggle lever 14 is set to be smaller than a distance L9*ab* between the entrance regions of the contacted surfaces 9*a* and 9*b* of the engagement portion 3. Further, at a region at which the facing interval between the contacted surfaces 9*a* and 9*b* coincides with the distance between the contact regions 14*a* and 14*b*, the contact regions 14*a* and 14*b* of the toggle lever 14 abut against the contacted surfaces 9*a* and 9*b*, respectively.

The contacted surfaces 9*a* and 9*b* of the engagement portion 3 are inclined surfaces inclined by a prescribed amount in the rotating direction (movement direction) of the toggle lever 14, and an interval L9 between the contacted surfaces 9*a* and 9*b* becomes gradually smaller from the entrance region of the contacted surfaces. That is, the contacted surfaces 9*a* and 9*b* of the engagement portion 3 are configured to face each other in a direction orthogonal to the rotating direction (movement direction) of the toggle lever 14, and configured to make the facing interval gradually smaller from an upstream side to a downstream side in the rotating direction toward a locked position. The relationship between the facing interval L9 between the contacted surfaces 9*a* and 9*b* at a position at which the contact regions 14*a* and 14*b* finally engage the engagement portion 3, the distance L14, and the distance L9*ab* is set as follows.

$$L9<L14<L9ab$$

Accordingly, when the toggle lever 14 rotates by a prescribed amount in the arrow K direction, the contact regions 14*a* and 14*b* come in contact with the contacted surfaces 9*a* and 9*b* of the engagement portion 3, respectively, before the toggle lever 14 reaches the final engagement position. The contact regions 14*a* and 14*b* come in contact with the contacted regions 9*a* and 9*b* at a timing at which the second urging force acts on the engaged member 14 from the urging member 13. In addition, the contacted regions 9*a* and 9*b* elastically deform when the contact regions 14*a* and 14*b* come in contact with the contacted regions 9*a* and 9*b*, respectively. Specifically, when the contact regions 14*a* and 14*b* enter between the pair of contacted surfaces 9*a* and 9*b* and come in contact with the same, the pair of contacted surfaces 9*a* and 9*b* elastically deforms such that the interval between the pair of contacted surfaces 9*a* and 9*b* expands by a force received from the contact regions 14*a* and 14*b*.

Figure 8A:
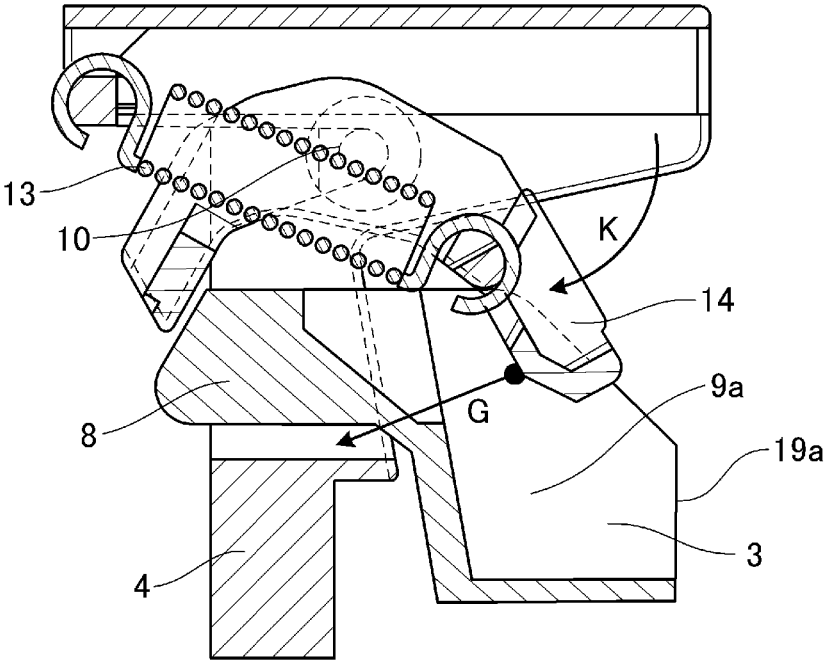
FIGS. 8A and 8B are views for describing the operation of the toggle mechanism according to the first embodiment.
Figure 8B:
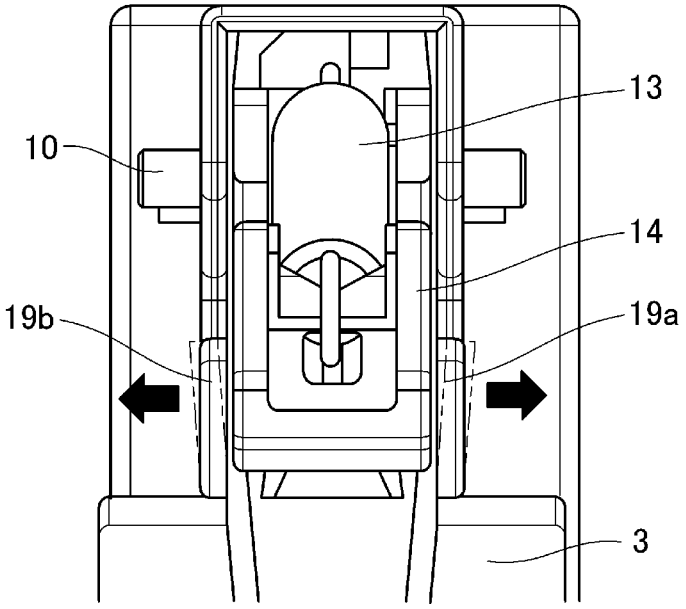

FIGS. 8A and 8B are schematic views showing the state of the engagement portion 3 and the toggle lever 14 when the front cover 2 is placed at the locked position (closed position) with respect to the apparatus main body 1. FIG. 8A is a schematic cross-sectional view cut perpendicular to the rotating shaft of the toggle lever 14, and FIG. 8B is a front view when seen in the direction perpendicular to the rotating shaft from the side of the engagement portion. When the contact regions 14*a* and 14*b* come in contact with the contacted surfaces 9*a* and 9*b*, respectively, the engagement portion 3 receives a force in the arrow G direction shown in FIG. 6C from the toggle lever 14, and then, as shown in FIGS. 8A and 8B, rotates with the toggle lever 14 up to the locked position at which the front cover 2 is set at a prescribed relative position with respect to the apparatus main body 1. Then, the toggle lever 14 attempts to further rotate with the reception of the urging force of the toggle spring 13 with respect to the engagement portion 3 stopped at the locked position. In the engagement portion 3, the abutted regions 19*a* and 19*b* serving as plate-shaped regions having the contacted surfaces 9*a* and 9*b*, respectively, are configured to be substantially parallel to the rotating direction of the toggle lever 14 as a whole although the normal direction of the contacted surfaces 9*a* and 9*b* is slightly inclined with respect to the rotating direction of the toggle lever 14. The abutted regions 19*a* and 19*b* may be assumed to be configured to have a cantilevered beam shape in which an entrance-side end and a back-side end in the facing region of the contacted surfaces 9*a* and 9*b* are a free end and a fixed end, respectively. Accordingly, the abutted regions 19*a* and 19*b* are configured to be elastically deformable in the normal direction of the contacted surfaces 9*a* and 9*b* due to collision with the toggle lever 14, i.e., configured to be deflectable due to collision with the toggle lever 14 in a manner in which the free-end side deviates with respect to the fixed-end side in the above cantilevered beam shape. Thus, by the pressing force of the toggle lever 14, the abutted regions 19*a* and 19*b* deform such that the facing interval between the contacted surfaces 9*a* and 9*b* expands. Then, when the toggle lever 14 reaches the position (locked position) at which the above elastic deformation of the abutted regions 19*a* and 19*b* is limited, the toggle lever 14 stops moving with respect to the engagement portion 3. Note that in order to reduce the degradation of the abutted regions 19*a* and 19*b* due to the elastic deformation, a restriction region that restricts the rotation of the toggle lever 14 before reaching the limitation of the above elastic deformation may be provided. When the toggle lever 14 and the engagement portion 3 are locked to each other and placed in a stopped state, the front cover 2 is locked to the apparatus main body 1 at the above locked position.

By the above elastic deformation of the abutted regions 19*a* and 19*b*, an impact that the engagement portion 3 receives at the collision of the toggle lever 14 is absorbed and buffered. As a result, it becomes possible to reduce the occurrence of an impact sound. For example, even if creep deformation occurs in the contacted surfaces 9*a* and 9*b* due to aging, the stopped position (locked position) of the toggle lever 14 slightly changes in the arrow K direction shown in FIG. 8A but no functional problem arises so long as the above relationship L9<L14<L9*ab* is satisfied. In addition, the effect of reducing an impact sound is maintained.

(Engagement Cancelling Operation of Toggle Mechanism from Closed State to Opening State of Front Cover)

Figure 9A:
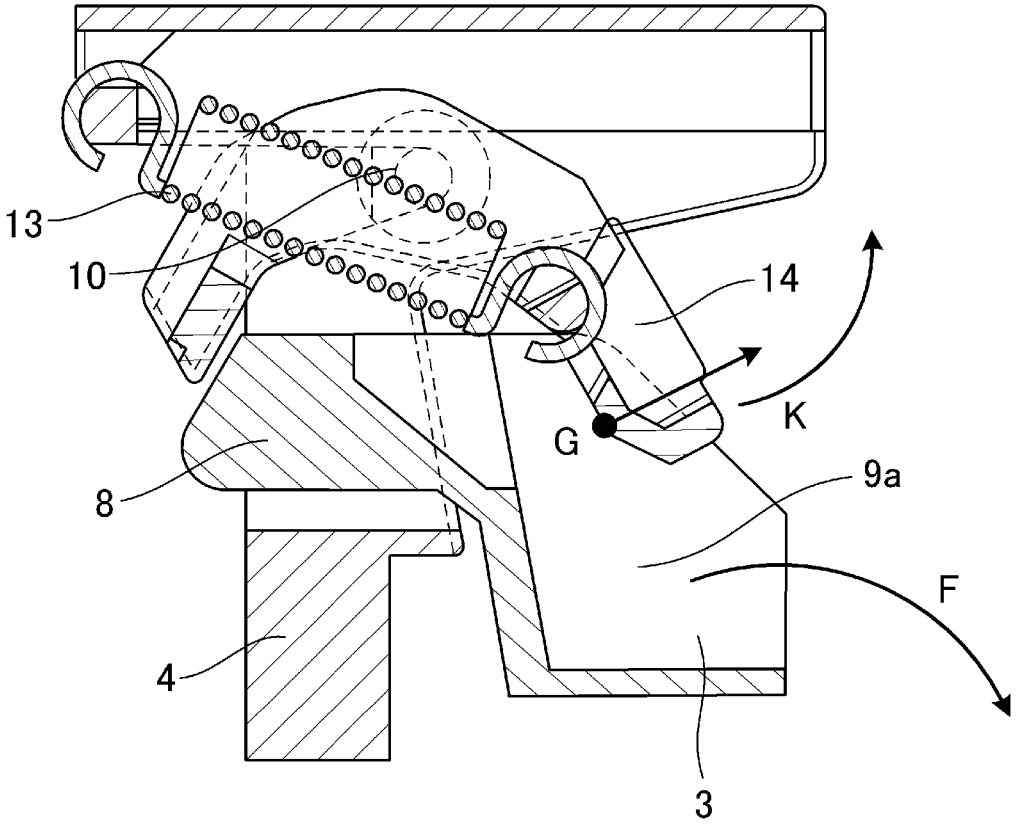
FIG. 9A is a view for describing the engagement cancelling operation of the toggle mechanism according to the first embodiment.

FIG. 9A is a view for describing the operation (engagement cancelling operation) of the toggle mechanism and a schematic cross-sectional view showing a state before the engagement portion 3 and the toggle lever 14 starting movement from the locked position have reached the neutral point at which the axis line of the toggle spring 13 coincides with the rotating shaft (swing shaft 10) of the toggle lever 14. Unless any external force exceeding the urging force of the toggle spring 13, the frictional force between the engagement portion 3 and the toggle lever 14, or the like acts on the front cover 2, the locked state between the front cover 2 and the apparatus main body 1 (the locked state between the engagement portion 3 and the toggle lever 14 shown in FIG. 6C) is maintained. When the user attempts to open the front cover 2 by a force exceeding the above urging force, the frictional force, or the like with respect to the apparatus main body 1, the engagement portion 3 starts opening along a track indicated by an arrow F while the toggle lever 14 also starts rotating in an arrow K direction with the swing shaft 10 as a rotating center. That is, the engagement cancelling operation of the toggle mechanism starts. At this time, the toggle spring 13 also follows the movement of the toggle lever 14 while changing its operation length and posture (angle of the line of action of the urging force).

Figure 9B:
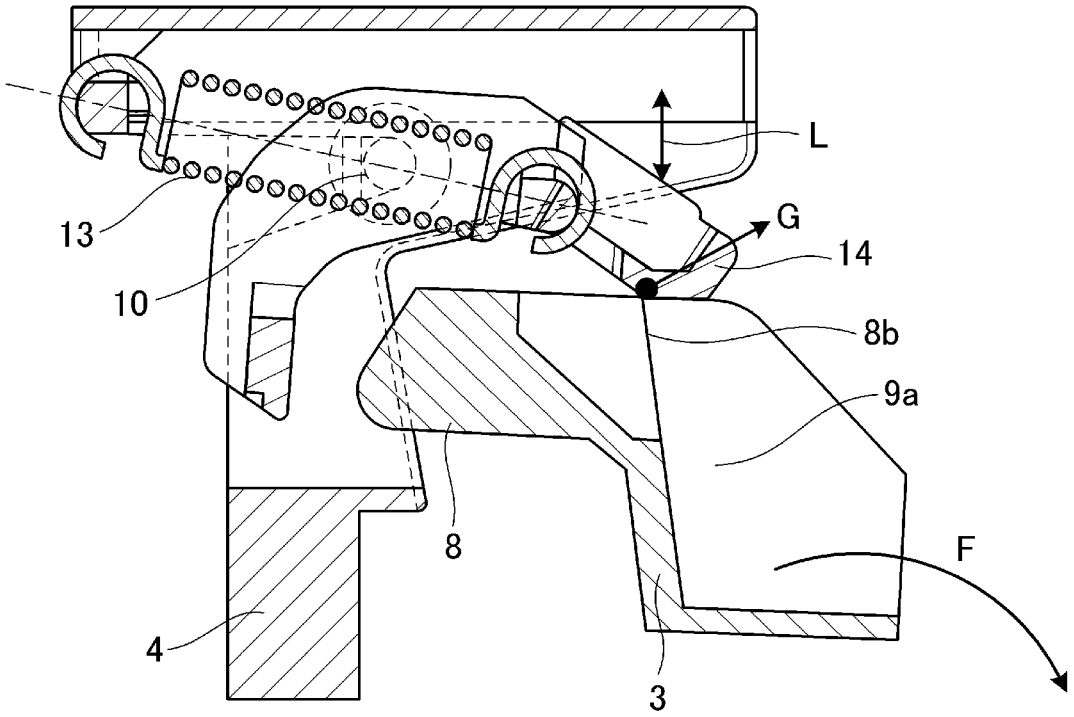
FIG. 9B is a view for describing the engagement cancelling operation of the toggle mechanism according to the first embodiment.

FIG. 9B is a view for describing the operation (engagement cancelling operation) of the toggle mechanism and a schematic cross-sectional view showing a state when the toggle lever 14 has reached the neutral point at which the axis line of the toggle spring 13 coincides with the rotating shaft (swing shaft 10) of the toggle lever 14. Like a case in which the cover is closed, the vicinity of the neutral point has a phase in which the toggle spring 13 applies an urging force to move the toggle lever 14 in a direction toward the center of the swing shaft 10, and the urging force of the toggle spring 13 is not converted into the rotating force of the toggle lever 14. At this time, a gap L exists between the toggle lever 14 and the toggle holder 4. The toggle lever 14 first rotates in the arrow K direction shown in FIG. 9A when the contact regions 14*a* and 14*b* are pressed by the contacted surfaces 9*a* and 9*b* of the engagement portion 3, and then exits from the facing region of the contacted surfaces 9*a* and 9*b* when the toggle lever 14 is pressed in an arrow G direction by a second pressing region 8*b* of the engagement portion 3. Then, after the contact regions 14*a* and 14*b* are separated from the contacted surfaces 9*a* and 9*b*, respectively, the toggle lever 14 is further pressed by the second pressing region 8*b* of the engagement portion 3. Thus, the toggle lever 14 further rotates in the arrow K direction shown in FIG. 9A and exceeds the neutral point.

Figure 9C:
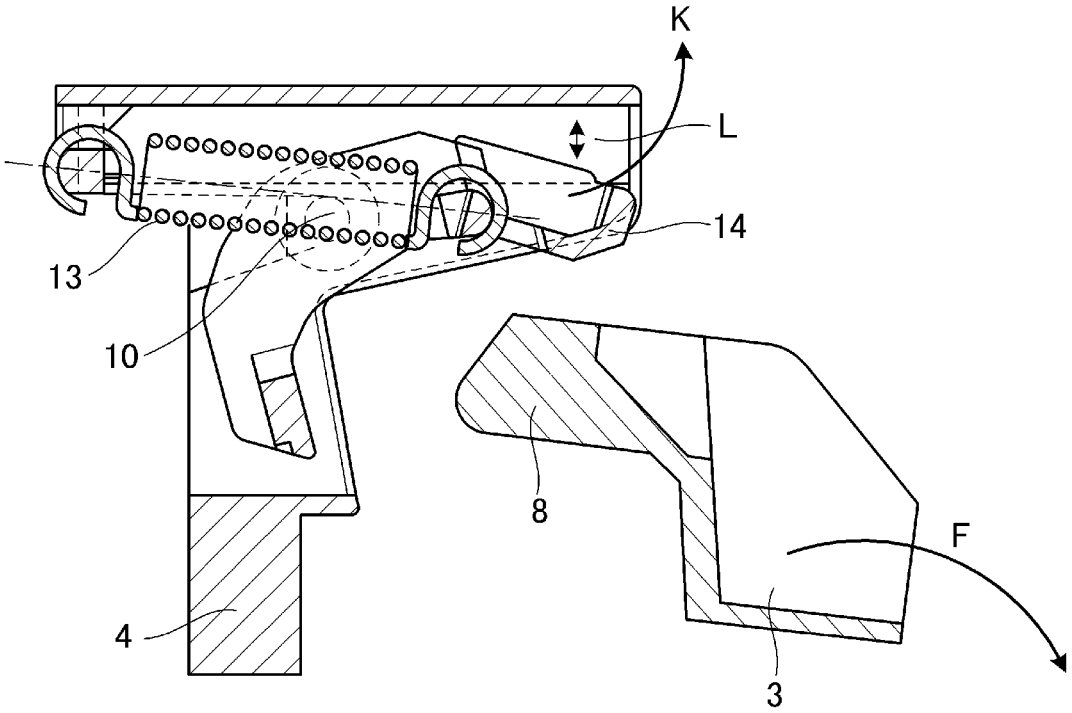
FIG. 9C is a view for describing the engagement cancelling operation of the toggle mechanism according to the first embodiment.

FIG. 9C is a view for describing the operation (engagement cancelling operation) of the toggle mechanism and a schematic cross-sectional view showing a state after the toggle lever 14 has passed through the neutral point at which the axis line of the toggle spring 13 coincides with the rotating shaft (swing shaft 10) of the toggle lever 14. As shown in FIG. 9C, when passing through the center of the swing shaft 10 of the toggle lever 14, the toggle spring 13 generates a force to rotate the toggle lever 14 in the arrow K direction. That is, when the toggle lever 14 is pressed by the engagement portion 3, the phase of the toggle lever 14 changes across the neutral point from the region (second region) on which the second urging force acts to the region (first region) on which the first urging force acts. After exceeding the neutral point, the toggle lever 14 continues to rotate only with the urging force of the toggle spring 13, eliminates the gap L between the toggle lever 14 and the toggle holder 4 at a stroke, and collides with the second contacted regions of the toggle holder 4 that will be described later. Thus, the rotation of the toggle lever 14 is restricted.

Figure 10A:
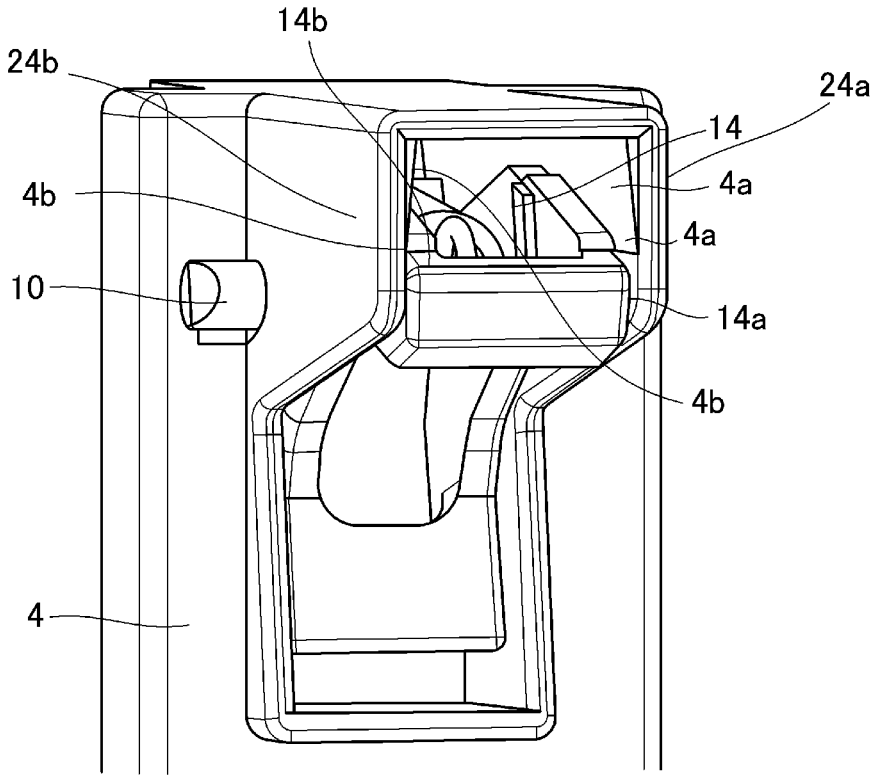
FIGS. 10A and 10B are schematic views for describing the details of the toggle mechanism according to the first embodiment.
Figure 10B:
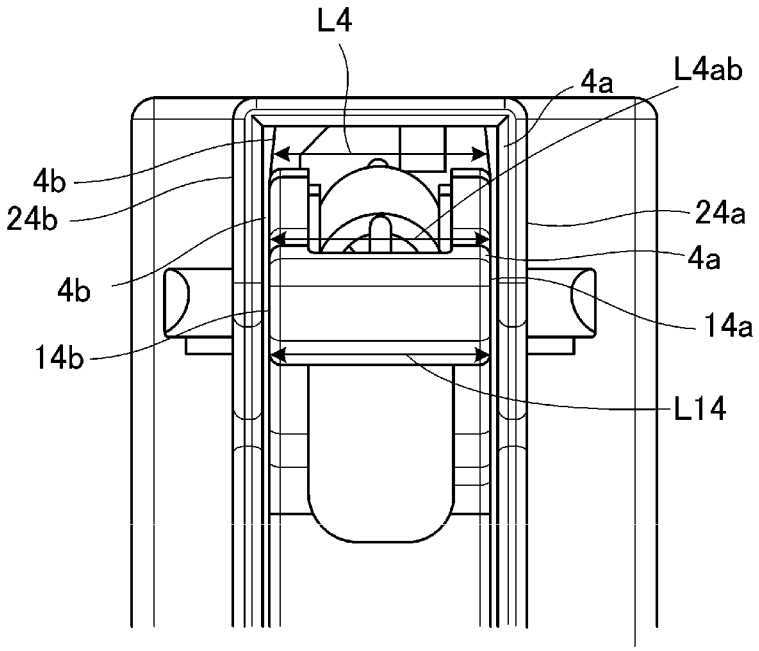

FIGS. 10A and 10B are schematic views for describing a state in which the contact regions 14*a* and 14*b* of the toggle lever 14 are abutted against the second contacted regions (second contacted surfaces) 4*a* and 4*b* of the toggle holder 4. FIG. 10A is a perspective view, and FIG. 10B is a front view. As shown in FIG. 10B, the contacted surfaces 4*a* and 4*b* of the toggle holder 4 are inclined surfaces inclined to make its facing interval wider on a side where the toggle lever 14 approaches. When rotating in the arrow K direction shown in FIG. 9A, the toggle lever 14 first passes through an entrance region at which the facing interval between the contacted surfaces 4*a* and 4*b* is the widest and then enters the facing region of the contacted surfaces 4*a* and 4*b*. That is, the width between the contact regions 14*a* and 14*b* (the distance L14 between the contact regions 14*a* and 14*b*) of the toggle lever 14 is set to be smaller than a distance L4*ab* between the entrance regions of the contacted surfaces 4*a* and 4*b* of the toggle holder 4. Further, at a region at which the facing interval between the contacted surfaces 4*a* and 4*b* coincides with the width between the contact regions 14*a* and 14*b*, the contact regions 14*a* and 14*b* of the toggle lever 14 abut against the contacted surfaces 4*a* and 4*b*, respectively.

The contacted surfaces 4*a* and 4*b* of the toggle holder 4 are inclined surfaces inclined by a prescribed amount in the rotating direction (movement direction) of the toggle lever 14, and an interval L4 between the contacted surfaces 4*a* and 4*b* becomes gradually smaller from the entrance region of the contacted surfaces. That is, the contacted surfaces 4*a* and 4*b* of the toggle holder 4 are configured to face each other in the direction orthogonal to the rotating direction (movement direction) of the toggle lever 14, and configured to make the facing interval gradually smaller from the upstream side to the downstream side in the rotating direction away from the locked position. The relationship between the facing interval L4 between the contacted surfaces 4*a* and 4*b* at a restricted position (standby position) at which the rotation of the contact regions 14*a* and 14*b* is finally restricted by the toggle holder 4 serving as a restriction member, the distance L14, and the distance L4*ab* is set as follows.

$$L4<L14<L4ab$$

Accordingly, when the toggle lever 14 rotates by a prescribed amount in the arrow K direction, the contact regions 14*a* and 14*b* come in contact with the contacted surfaces 4*a* and 4*b* of the toggle holder 4, respectively, before the toggle lever 14 reaches the final restricted position.

Figure 11A:
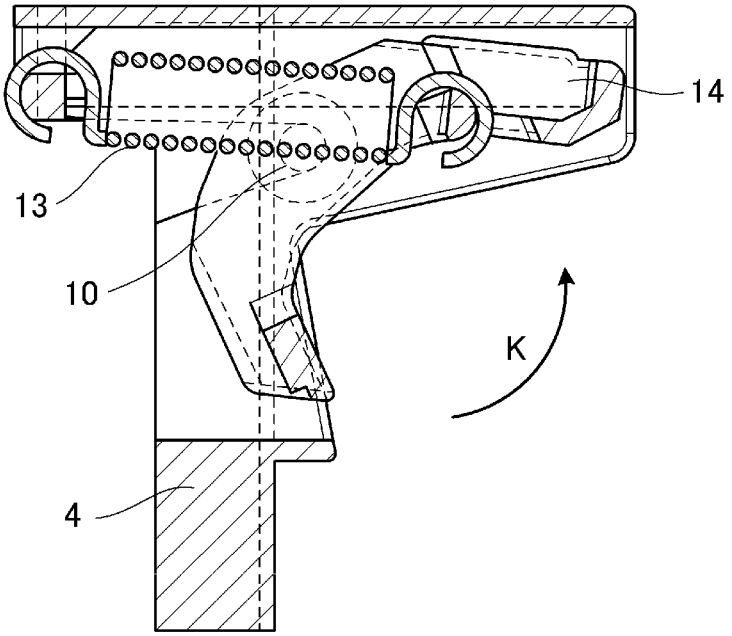
FIGS. 11A and 11B are schematic views for describing the details of the toggle mechanism according to the first embodiment.
Figure 11B:
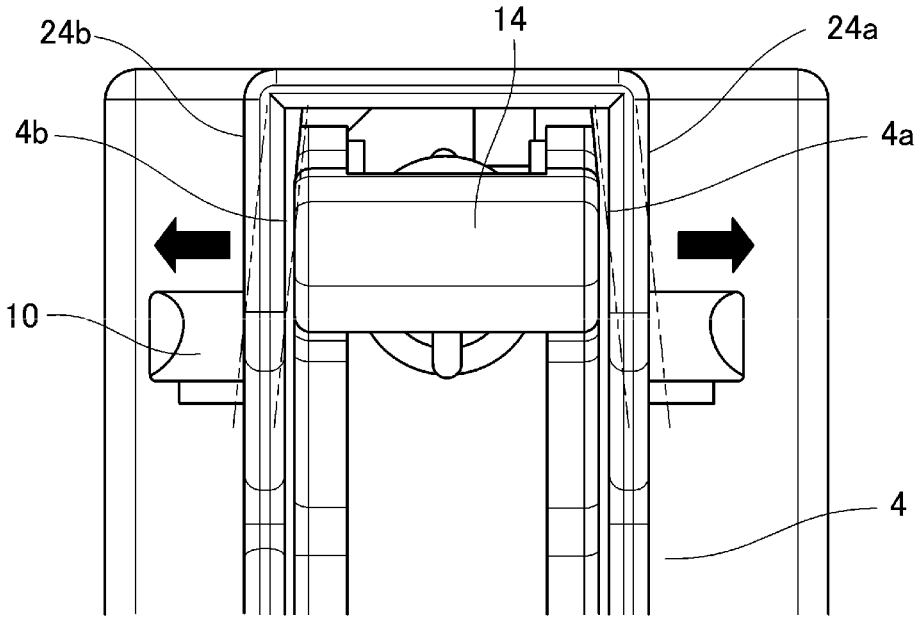

FIGS. 11A and 11B are schematic views showing the state of the toggle holder 4 and the toggle lever 14 in a state in which the front cover 2 is opened with respect to the apparatus main body 1 (the engagement portion 3 is completely separated from the toggle holder 4). FIG. 11A is a schematic cross-sectional view, and FIG. 11B is a front view. In the toggle holder 4, abutted regions 24*a* and 24*b* serving as plate-shaped regions having the contacted surfaces 4*a* and 4*b*, respectively, are configured to be substantially parallel to the rotating direction of the toggle lever 14 as a whole although the normal direction of the contacted surfaces 4*a* and 4*b* is slightly inclined with respect to the rotating direction of the toggle lever 14. The abutted regions 24*a* and 24*b* may be assumed to be configured to have a cantilevered beam shape in which an entrance-side end and a back-side end in the facing region of the contacted surfaces 4*a* and 4*b* are a free end and a fixed end, respectively. Accordingly, the abutted regions 24*a* and 24*b* are configured to be elastically deformable in the normal direction of the contacted surfaces 4*a* and 4*b* due to collision with the toggle lever 14, i.e., configured to be deflectable due to collision with the toggle lever 14 in a manner in which the free-end side deviates with respect to the fixed-end side in the above cantilevered beam shape. Thus, by the pressing force of the toggle lever 14, the abutted regions 24*a* and 24*b* deform such that the facing interval between the contacted surfaces 4*a* and 4*b* expands. Then, when the toggle lever 14 reaches the position (locked position) at which the above elastic deformation of the abutted regions 24*a* and 24*b* is limited, the toggle lever 14 stops moving with respect to the toggle holder 4. Note that in order to reduce the degradation of the abutted regions 24*a* and 24*b* due to the elastic deformation, the restriction region that restricts the rotation of the toggle lever 14 before reaching the limitation of the above elastic deformation may be provided. As described above, the position of the toggle lever 14 in a state in which the toggle lever 14 is locked to the toggle holder 4 and the rotation of the toggle lever 14 is stopped with respect to the toggle holder 4 is a rotation restricted position defined by the toggle holder 4, which represents the standby position of the toggle lever 14 when the front cover 2 is opened.

By the above elastic deformation of the abutted regions 24*a* and 24*b* serving as the second abutted regions, an impact that the toggle holder 4 receives at the collision of the toggle lever 14 is absorbed and buffered. As a result, it becomes possible to reduce the occurrence of an impact sound. For example, even if creep deformation occurs in the contacted surfaces 4*a* and 4*b* due to aging, the stopped position (locked position) of the toggle lever 14 slightly changes in the arrow K direction shown in FIG. 11A but no functional problem arises so long as the above relationship L4<L14<L4*ab* is satisfied. In addition, the effect of reducing an impact sound is maintained.

As described above, according to the embodiment, kinetic energy in the swing direction of the toggle lever 14 is converted into deformation energy in a direction substantially perpendicular to the swing direction, whereby it is possible to absorb and buffer the impact between the engagement portion 3, the toggle lever 14, and the toggle holder 4. Accordingly, it is possible to provide an engagement system for locking a rotatable cover to an apparatus main body, the engagement system being allowed to reduce the occurrence of an impact sound caused by rapidly eliminating engagement looseness described in the related art and solve an impact sound without impairing usability. In the embodiment, the contacted surfaces 9*a* and 9*b* of the engagement portion 3 and the contacted surfaces 4*a* and 4*b* of the toggle holder 4 are configured to be elastically deformable. However, the same effect is obtained even when the contact regions 14*a* and 14*b* of the toggle lever 14 are configured to elastically deform.

In addition, in the embodiment, the toggle lever 14 serving as an engaged member is configured to be rotatably supported by the apparatus main body 1 via the toggle holder 4 and configured to be coupled to the apparatus main body 1 via the toggle spring 13 and the toggle holder 4. However, other configurations may be employed. For example, the toggle holder 4 may be configured to be integrated with the frame body of the apparatus main body 1, and the toggle lever 14 may be configured to be directly rotatably supported by the apparatus main body 1 and coupled to the apparatus main body via the toggle spring 13.

Second Embodiment

A description will be given, with reference to FIGS. 12 to 17, of a locking mechanism according to a second embodiment of the present invention. The main configuration of an image forming apparatus main body 1 is the same as that of the first embodiment. Therefore, the points of the second embodiment different from those of the first embodiment will be mainly described. The items of the second embodiment that will be not described here are the same as those of the first embodiment.

Figure 12:
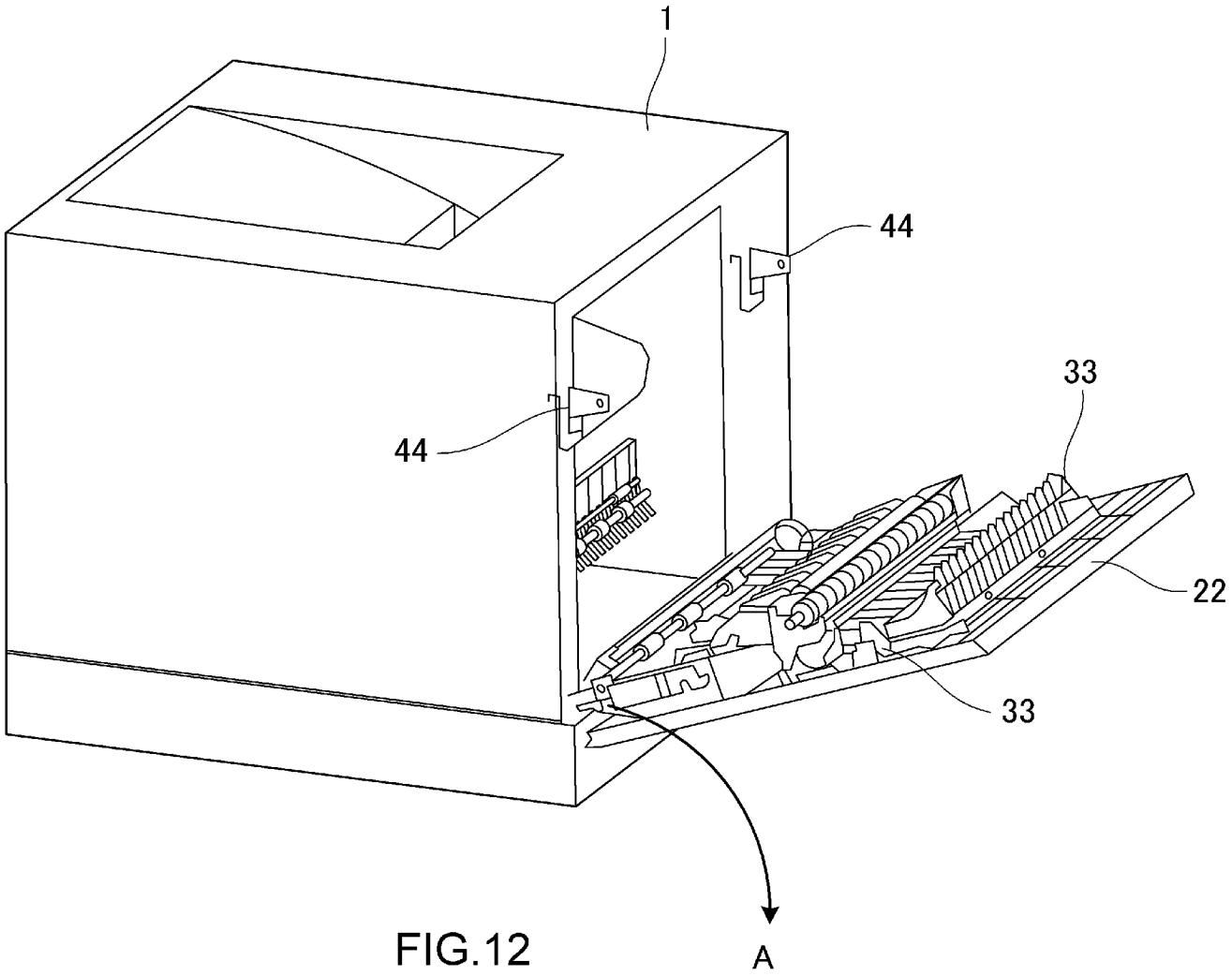
FIG. 12 is a schematic view showing a state in which the cover of an image forming apparatus according to a second embodiment is opened.

FIG. 12 is a schematic perspective view showing a state in which a jam processing cover 22 is opened with respect to the image forming apparatus main body 1. As shown in FIG. 12, the jam processing cover 22 serving as an opening/closing door is configured to rotate in an arrow A direction with respect to the apparatus main body 1 to open a transporting path for a recording material inside the apparatus main body 1 to an outside such that a user is allowed to access the recording material stopped in the transporting path due to the occurrence of a jam. The arrow A direction is a direction parallel to a horizontal surface. On the surface of the apparatus main body 1 which the jam processing cover 22 at its closed position faces, toggle holders 44 having a toggle mechanism to lock the jam processing cover 22 at the closed position are fixed. On the other hand, on the surface of the jam processing cover 22 that faces the apparatus main body 1 (on the rear surface of the jam processing cover 22), engagement portions 33 that engage the toggle mechanisms of the toggle holders 44 are fixed at positions corresponding to the toggle holders 44. The toggle holders 44 are provided at two upper places of the opening of the frame body of the apparatus main body 1. Since the operation of the toggle mechanisms when the jam processing cover 22 is opened/closed is the same as that of the front cover 2 in the first embodiment, its description will be omitted here.

(Characteristic Configuration in Second Embodiment)

Figure 13A:
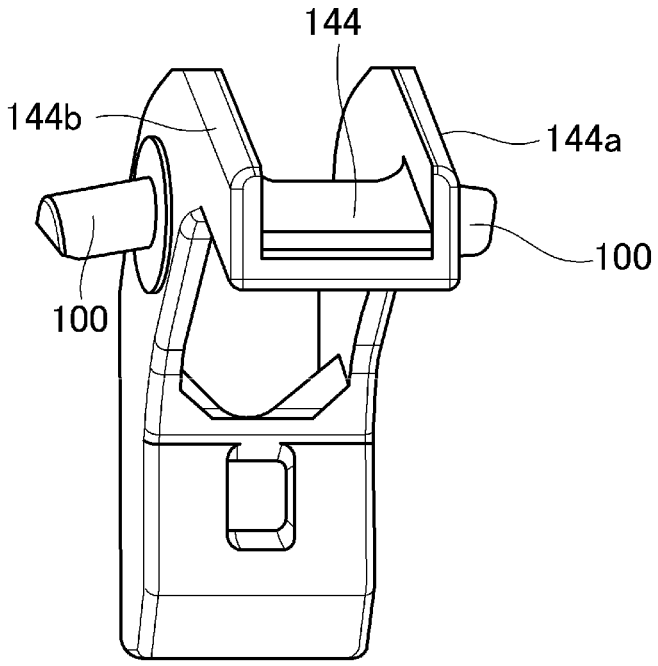
FIGS. 13A and 13B are views for describing a toggle lever according to the second embodiment.
Figure 13B:
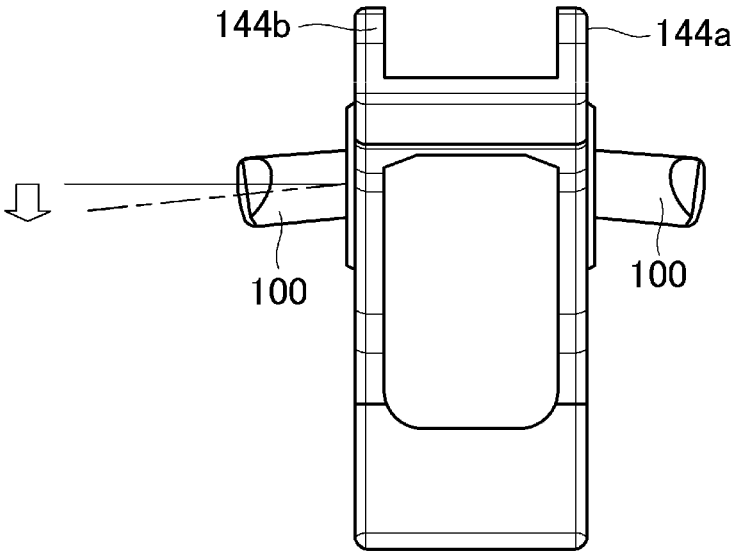

FIGS. 13A and 13B are views for describing the details of a toggle lever 144 in the second embodiment. FIG. 13A is a perspective view, and FIG. 13B is a front view. A swing shaft 100 of the toggle lever 144 extends to be inclined by a prescribed amount in a direction (arrow direction in FIG. 13B) away from a direction perpendicular to the surfaces of contact regions 144*a* and 144*b* of the toggle lever 144.

Figure 14B:
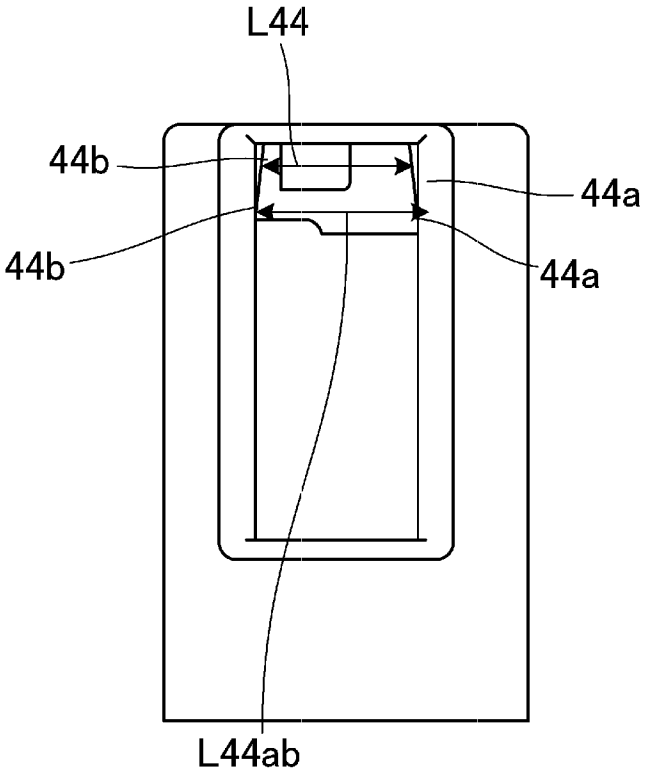
FIGS. 14A and 14B are views for describing a toggle holder according to the second embodiment.
Figure 14A:
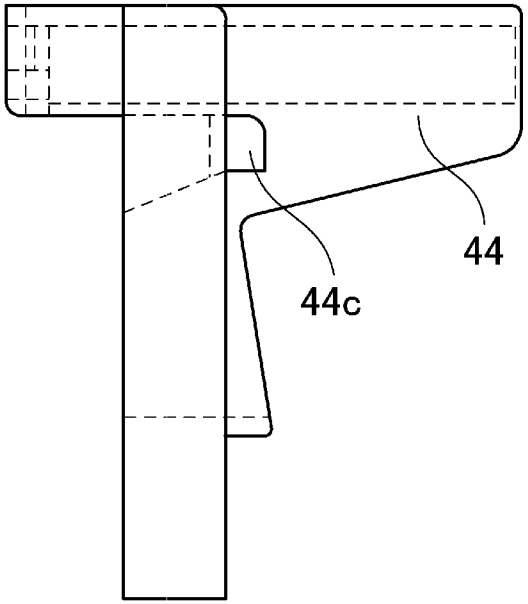

FIGS. 14A and 14B are views for describing the details of the toggle holder 44 in the second embodiment. FIG. 14A is a side view, and FIG. 14B is a front view. Like the toggle holder 4 of the first embodiment, the toggle holder 44 has second contacted surfaces 44*a* and 44*b* with which the contact regions 144*a* and 144*b* of the toggle lever 144 come in contact when the jam processing cover 22 is opened. A facing interval L44 between the contacted surfaces 44*a* and 44*b* becomes gradually smaller from the entrance region of the contacted surfaces 44*a* and 44*b* toward the swing direction of the toggle lever 144. In addition, the toggle holder 44 has a swing central hole 44*c* in which the swing shaft 100 of the toggle lever 144 is inserted. The swing central hole 44*c* is a long hole longer than the diameter of the swing shaft 100 in the vertical direction shown in FIGS. 14A and 14B.

Figure 15A:
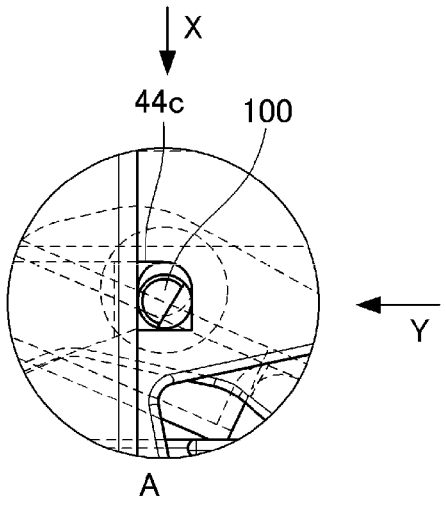
FIGS. 15A to 15D are views for describing the operation of a toggle mechanism according to the second embodiment.
Figure 15B:
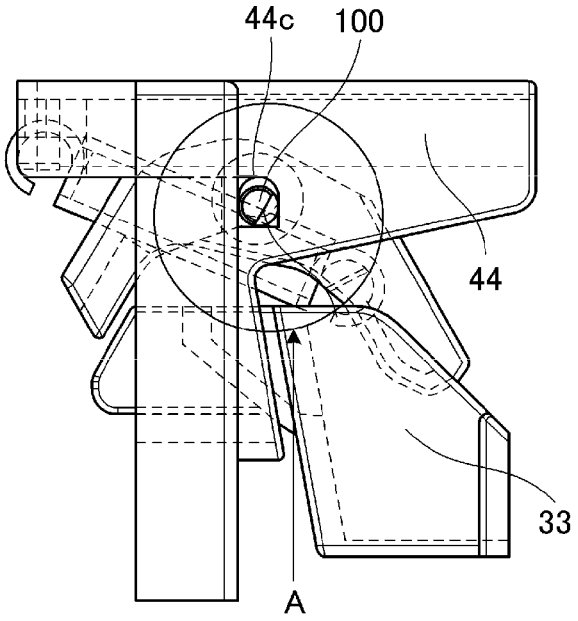
Figure 15C:
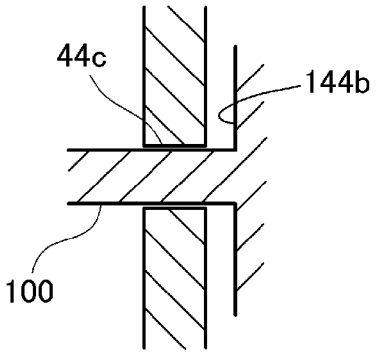
Figure 15D:
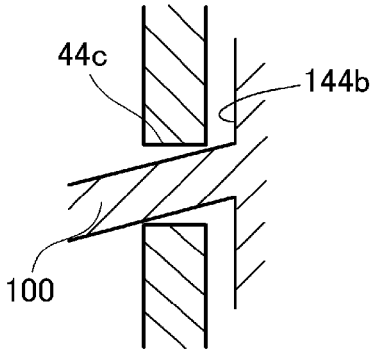

FIGS. 15A to 15D are schematic views of the toggle mechanism in a state in which the jam processing cover 22 is locked to the apparatus main body 1. FIG. 15B is a side perspective view, FIG. 15A is an enlarged view of a region A in FIG. 15B, FIG. 15C is a cross-sectional view taken along an arrow X in FIG. 15A, and FIG. 15D is a cross-sectional view taken along an arrow Y in FIG. 15A. As shown in FIGS. 15A to 15D, the swing central hole 44*c* is a hole long in a direction (vertical direction) perpendicular to the horizontal surface representing an apparatus installation surface. The swing central hole 44*c* penetrates in a horizontal direction and is formed at a place having the contacted surfaces 44*a* and 44*b* of the toggle holder 44. As shown in FIG. 15C, the width of the swing central hole 44*c* in the horizontal direction is set to be the same as that of the swing shaft 100. In addition, as shown in FIG. 15D, the width of the swing central hole 44*c* in the vertical direction is set to be greater than that of the swing central hole 44*c* in the horizontal direction by a degree to which the swing shaft 100 inclined by the prescribed amount is accommodated. As shown in FIGS. 15A to 15D, in a state in which the jam processing cover 22 is locked to the apparatus main body 1, any special load does not occur in the toggle lever 144 at the engagement segment between the swing shaft 100 and the swing central hole 44*c*.

Figure 16A:
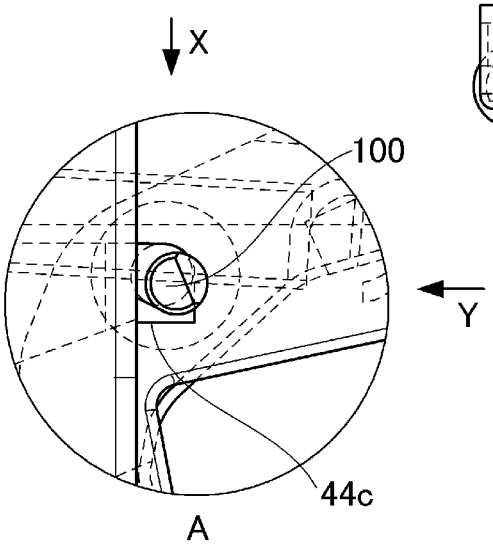
FIGS. 16A to 16D are views for describing the operation of the toggle mechanism according to the second embodiment.
Figure 16B:
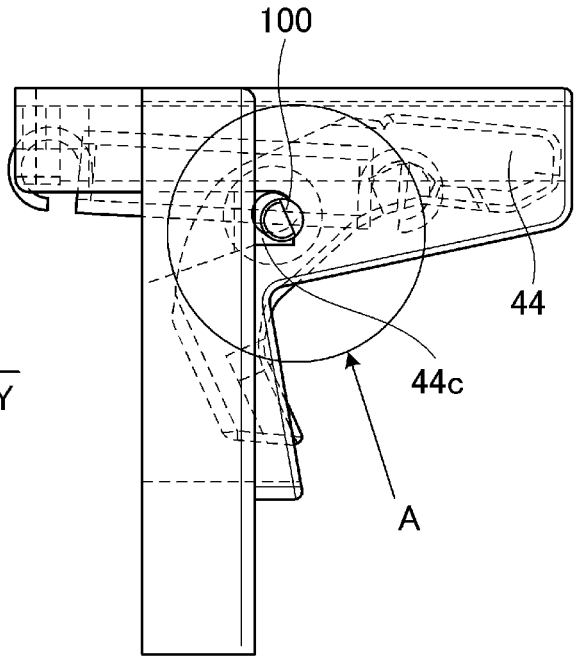
Figure 16C:
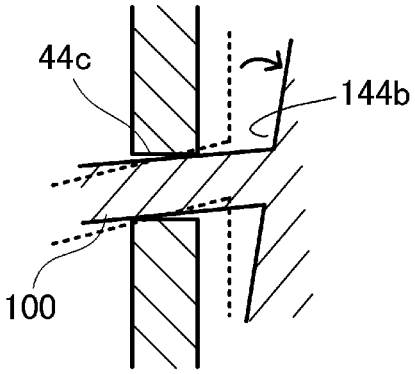
Figure 16D:
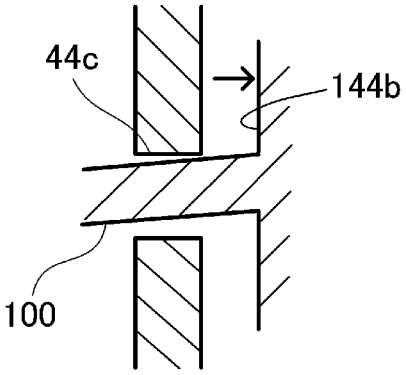

FIGS. 16A to 16D are schematic views of the toggle mechanism in a state in which the toggle lever 144 is disengaged from the engagement portion 33 and set at a standby position. FIG. 16B is a side perspective view, FIG. 16A is an enlarged view of a region A in FIG. 16B, FIG. 16C is a cross-sectional view taken along an arrow X in FIG. 16A, and FIG. 16D is a cross-sectional view taken along an arrow Y in FIG. 16A. When the toggle lever 144 is disengaged from the engagement portion 33 and the jam processing cover 22 is opened with respect to the apparatus main body, the toggle lever 144 rotates with respect to the toggle holder 44, whereby the engagement state between the swing shaft 100 and the swing central hole 44*c* changes. As shown in FIG. 16C, a phase in which the inclination of the swing shaft 100 becomes maximum is the horizontal direction. However, the swing central hole 44*c* in the horizontal direction has only the width of the swing shaft 100 or so. Therefore, when the facing surfaces of the toggle lever 144 and the toggle holder 44 at the engagement segment between the swing shaft 100 and the swing central hole 44*c* are kept parallel as shown in FIG. 15C, the swing shaft 100 interferes with the swing central hole 44*c* and thus is not allowed to be accommodated as shown by dashed lines in FIG. 16C. Accordingly, by the interference between the swing shaft 100 and the swing central hole 44*c*, a load acts on the toggle lever 144 in a direction different from the swing direction of the toggle lever 144 as indicated by arrows in FIGS. 16C and 16D. The inclination angle and the inclination direction of the swing shaft 100 are set such that a resistance force that the swing shaft 100 receives from the swing central hole 44*c* by rotation increases as the rotating phase of the toggle lever 144 is away from a neutral point toward the standby position. Thus, it is possible to reduce a swing force after the toggle lever 144 exceeds the neutral point.

Figure 17:
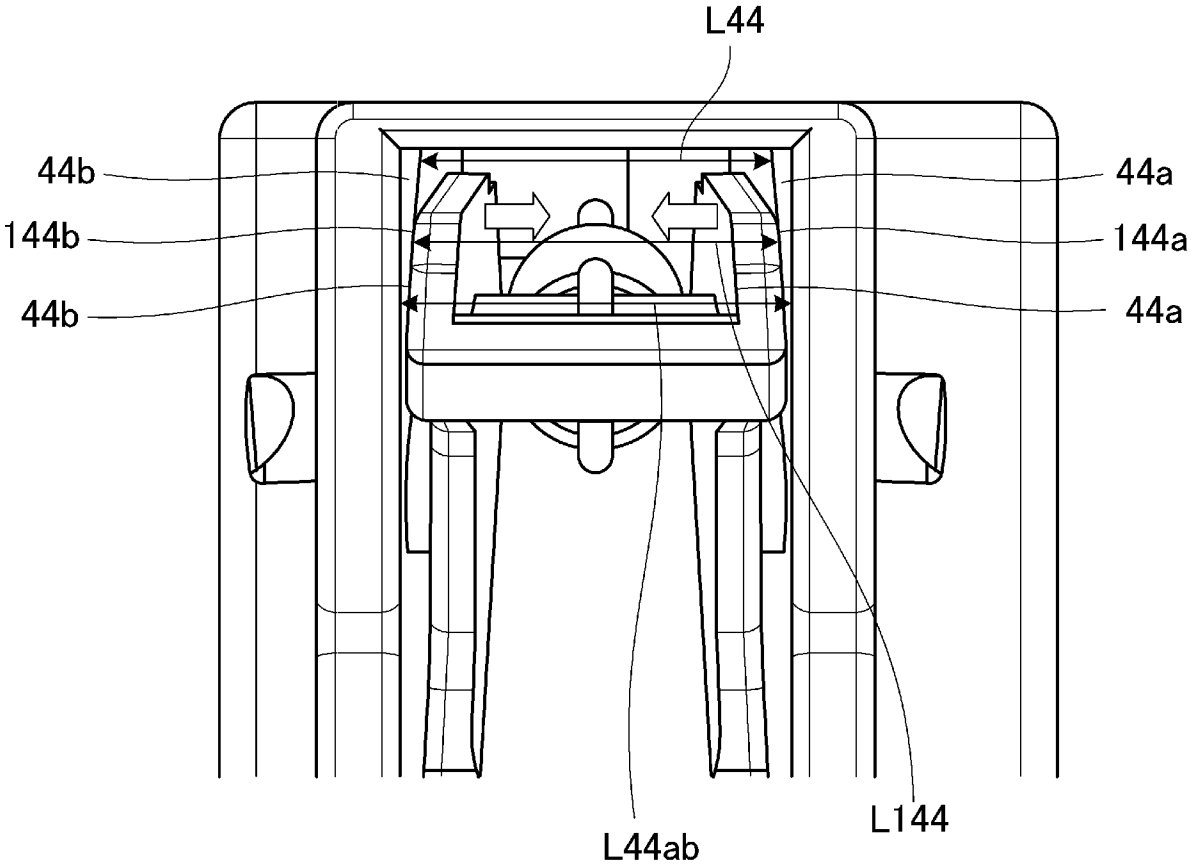
FIG. 17 is a schematic view for describing the details of the toggle mechanism according to the second embodiment.
Figure 18A:
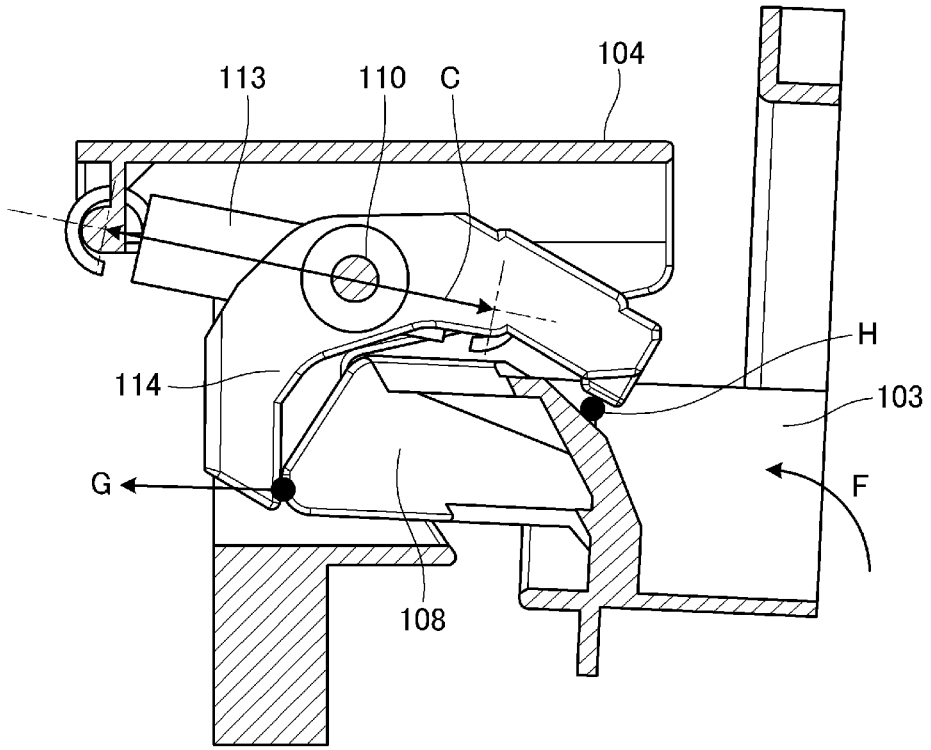
FIGS. 18A and 18B are cross-sectional views of the toggle mechanism.
Figure 18B:
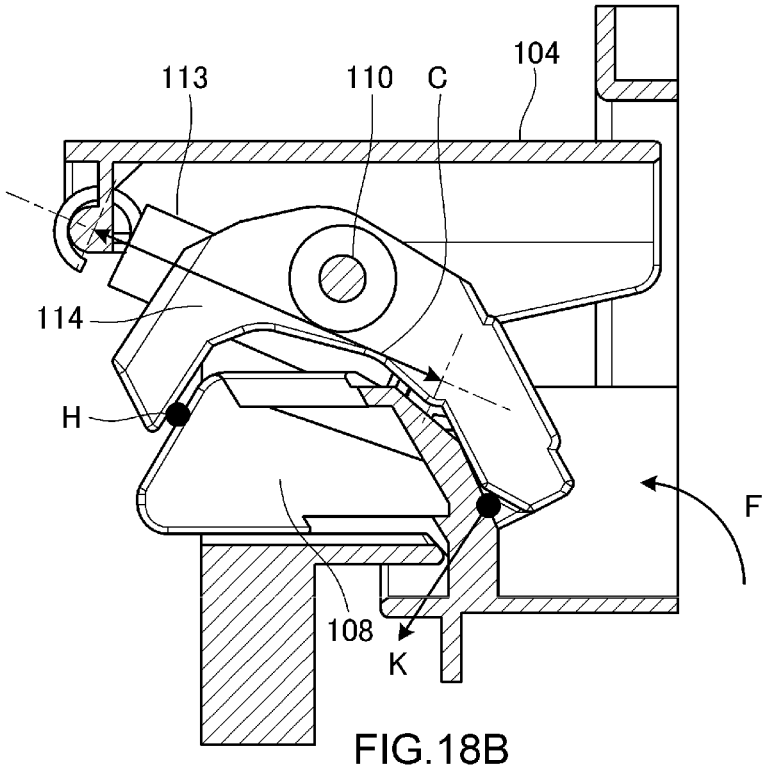
Figure 19A:
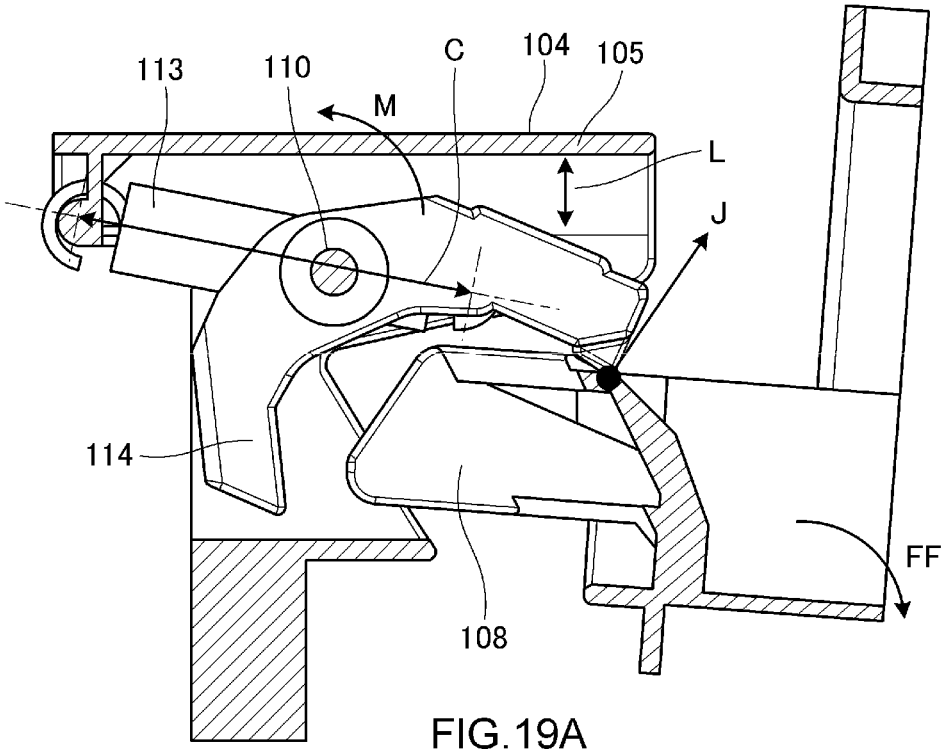
FIGS. 19A and 19B are cross-sectional views of the toggle mechanism.
Figure 19B:
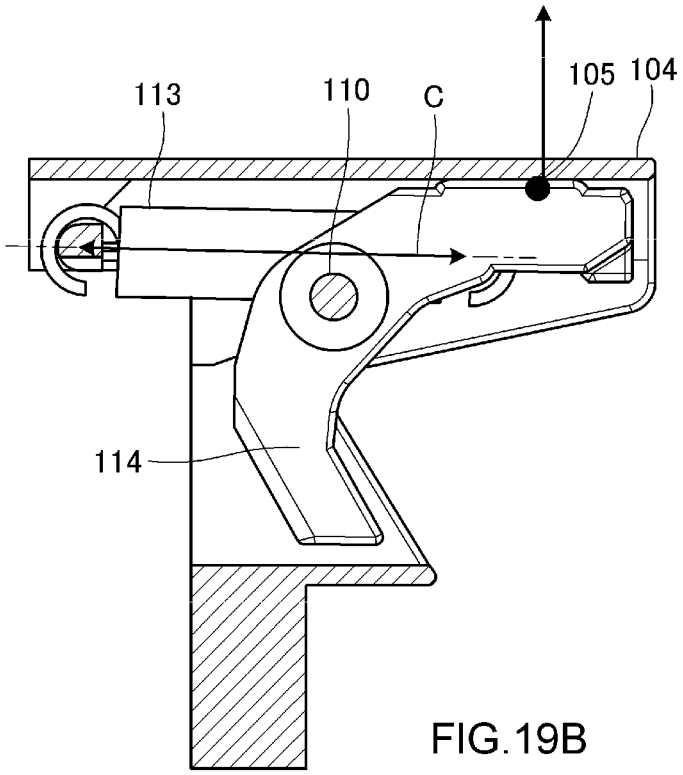

FIG. 17 is a schematic view for describing a mechanism to reduce the impact sound of the toggle mechanism in the second embodiment. As shown in FIG. 17, the contacted surfaces 44*a* and 44*b* of the toggle holder 44 are inclined surfaces inclined by a prescribed amount in the rotating direction (movement direction) of the toggle lever 144, and a distance L44 between the contacted surfaces 44*a* and 44*b* becomes gradually smaller from the entrance region of the contacted surfaces. That is, the contacted surfaces 44*a* and 44*b* are configured to face each other in the direction orthogonal to the rotating direction (movement direction) of the toggle lever 144, and configured to make the facing interval gradually smaller from an upstream side to a downstream side in the rotating direction away from a locked position. The relationship between the facing interval L44 between the contacted surfaces 44*a* and 44*b* at a restricted position (standby position) at which the contact regions 144*a* and 144*b* are finally restricted, the distance L144 between the contact regions 144*a* and 144*b*, and the facing interval L44*ab* between the contacted surfaces 44*a* and 44*b* at the entrance region is set as follows.

$$L44 < L144 < L44ab$$

Accordingly, when the toggle lever 144 rotates by a prescribed amount toward the standby position, the contact regions 144*a* and 144*b* come in contact with the contacted surfaces 44*a* and 44*b* of the toggle holder 44, respectively, before the toggle lever 144 reaches the standby position.

The contact regions 144*a* and 144*b* of the toggle lever 144 are a pair of plate-shaped regions extending substantially parallel in the rotating direction of the toggle lever 144 and provided with the swing shaft 100. Accordingly, when colliding with the contacted surfaces 44*a* and 44*b*, the contact regions 144*a* and 144*b* receive a force in a direction different from the swing direction from the inclined contacted surfaces 44*a* and 44*b* and receive a force in a direction different from the swing direction due to a load caused when the swing shaft 100 interferes with the swing central hole 44*c*. Thus, as indicated by arrows in FIG. 17, the contact regions 144*a* and 144*b* elastically deform so as to narrow the facing interval. By the elastic deformation, the contact regions 144*a* and 144*b* of the toggle lever 144 are caused to absorb an impact when colliding with the contacted surfaces 44*a* and 44*b* of the toggle holders 44 and thus allowed to reduce the occurrence of an impact sound.

Accordingly, it is possible to provide an engagement system for locking a rotatable cover to an apparatus main body, in which an impact sound caused by rapidly eliminating engagement looseness described in the related art is not generated and an impact sound may be eliminated without impairing usability.

Note that in the second embodiment, the swing shaft 100 is configured to be inclined with respect to the rotation axis of the toggle lever 144, and the swing central hole 44*c* is configured to penetrate in a direction parallel to the rotation axis of the toggle lever 144. However, other configurations may be employed. For example, the swing shaft 100 may be configured to extend parallel to the rotation axis of the toggle lever 144, and the swing central hole 44*c* may be configured to penetrate in a direction inclined with respect to the rotation axis of the toggle lever 144.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-39336, filed on Mar. 1, 2016, which is hereby incorporated by reference herein in its entirety.

What is claimed is:

1. An image forming apparatus comprising:

a main body of the image forming apparatus;

an opening/closing door openable/closable with respect to the main body;

a locking mechanism that is provided on the main body and locks the opening/closing door to an engagement position, the locking mechanism having a rotatable engaged member and an urging member that urges the engaged member; and an engagement member that is provided on the opening/closing door and engages the engaged member, wherein the engaged member is pressed and rotated by the engagement member when the opening/closing door is closed with respect to the main body, wherein an urging force acting on the engaged member from the urging member is converted from a first urging force to press out the engagement member to a second urging force to draw the engagement member into the engagement position when the engaged member is pressed and rotated by the engagement member, wherein the engagement member has a contacted region and the engaged member has a contact region that comes in contact with the contacted region, and wherein the contacted region elastically deforms when the contact region comes in contact with the contacted region.

2. The image forming apparatus according to claim 1, wherein the contact region is configured to come into contact with the contacted region at a timing at which the second urging force acts on the engaged member from the urging member.

3. The image forming apparatus according to claim 1, wherein the contacted region has a pair of contacted surfaces facing each other, and the pair of contacted surfaces elastically deforms so as to make an interval thereof wider by a force received from the contact region when the contact region enters a space between the pair of contacted surfaces and comes in contact with the pair of contacted surfaces.

4. The image forming apparatus according to claim 1, wherein the locking mechanism has a second contacted region with which the contact region of the engaged member comes in contact, and the contact region comes in contact with the second contacted region after the engagement member is separated from the engaged member.

5. The image forming apparatus according to claim 4, wherein the second contacted region has a pair of second contacted surfaces facing each other, and the pair of second contacted surfaces elastically deforms so as to make an interval thereof wider by a force received from the contact region when the contact region enters a space between the pair of second contacted surfaces and comes in contact with the pair of second contacted surfaces.

6. The image forming apparatus according to claim 1, wherein the engaged member is supported by a shaft inserted in a long hole so as to be rotatable with respect to the locking mechanism, the long hole penetrating parallel to a rotation axis, and wherein the shaft is inclined with respect to the rotation axis in a rotating direction of the engaged member so as to receive a greater resistance force from the long hole by rotation of the engaged member as the shaft is separated from a neutral point on which neither the first urging force nor the second urging force act.

* * * * *